US009877589B2

(12) United States Patent
Dewert

(10) Patent No.: US 9,877,589 B2
(45) Date of Patent: Jan. 30, 2018

(54) ELECTROMOTIVELY ADJUSTABLE SUPPORT APPARATUS, SUCH AS A SUPPORT DEVICE ADJUSTABLE BY AN ELECTRIC MOTOR

(71) Applicant: de Werth Group AG, Zurich (CH)

(72) Inventor: Eckhart Dewert, Goldingen (CH)

(73) Assignee: de Werth Group AG, Zürich (CH)

( * ) Notice: Subject to any disclaimer, the term of this patent is extended or adjusted under 35 U.S.C. 154(b) by 237 days.

(21) Appl. No.: 14/799,376

(22) Filed: Jul. 14, 2015

(65) Prior Publication Data

US 2016/0037937 A1 Feb. 11, 2016

(30) Foreign Application Priority Data

Jul. 18, 2014 (DE) ..... 10 2014 110 114
Oct. 16, 2014 (DE) ..... 10 2014 115 033

(51) Int. Cl.
*A47C 20/04* (2006.01)
*A47C 1/024* (2006.01)
(Continued)

(52) U.S. Cl.
CPC ..... *A47C 20/041* (2013.01); *A47C 1/0242* (2013.01); *A47C 1/0342* (2013.01); *A61G 7/015* (2013.01); *A61G 7/018* (2013.01)

(58) Field of Classification Search
CPC ... A47C 20/041; A47C 1/0242; A47C 1/0342; A61G 7/018; A61G 7/015
(Continued)

(56) References Cited

U.S. PATENT DOCUMENTS 2,751,606 A 6/1956 Benker ..... A61G 7/015 5/614
3,414,913 A 12/1968 Stanley ..... A61G 7/002 5/616
(Continued)

FOREIGN PATENT DOCUMENTS

DE 2614105 A1 10/1976
DE 3103922 A1 8/1982
(Continued)

OTHER PUBLICATIONS

Office Action in European Patent App. No. 15 002 100.4 related to U.S. Appl. No. 14/799,376, filed Jul. 14, 2015 & 3 pg. European Search Report, dtd 17 Nov. 20, 2015 (6 pages).

*Primary Examiner* — Robert G Santos
*Assistant Examiner* — Myles A Throop
(74) *Attorney, Agent, or Firm* — Shlesinger, Arkwright & Garvey LLP

(57) ABSTRACT

Electromotively adjustable support apparatus for supporting padding of seating and/or reclining furniture, in particular a mattress of a bed, has at least two support parts adjustable relative to one another. The adjustable support apparatus may be adjusted by an electric motor. An adjustment element is associated with one support part for adjusting the support part. Adjustment element is in drive connection with an electric motor of a drive unit. The adjustment element is a pivot lever which is pivotable under the traction effect of a pull cable of a Bowden cable, and is configured and connected with the pull cable in such a way that the lever arm which is operative for adjusting the support part lengthens during an adjustment from an unadjusted starting position into a maximally adjusted end position of the adjustment movement.

13 Claims, 39 Drawing Sheets

(51) Int. Cl.
*A47C 1/034* (2006.01)
*A61G 7/015* (2006.01)
*A61G 7/018* (2006.01)

(58) Field of Classification Search
USPC ..... 297/330, 85 M, 118, 354.13, 284.4, 297/284.7, 384.7; 5/190, 227, 306
See application file for complete search history.

(56) References Cited

U.S. PATENT DOCUMENTS

| | | | | |
|---|---|---|---|---|
| 4,774,732 | A | 10/1988 | Riedl | A47C 20/047 297/354.12 |
| 5,105,486 | A | 4/1992 | Peterson | A47C 19/045 5/611 |
| 5,528,948 | A | 6/1996 | De Gelis | |
| 5,926,877 | A | 7/1999 | Lin | A47C 20/041 297/330 |
| 6,754,922 | B2 | 6/2004 | Dewert | A47C 20/041 5/613 |
| 6,961,971 | B2 | 11/2005 | Schneider et al. | |
| 7,484,257 | B2 | 2/2009 | Schneider | A47C 20/041 5/613 |
| 7,770,972 | B2 | 8/2010 | Popa | B60N 2/0296 297/284.4 |
| 8,973,185 | B2 | 3/2015 | Dewert et al. | |
| 2002/0113472 | A1 | 8/2002 | Blendea | B60N 2/0232 297/284.4 |
| 2003/0052238 | A1 | 3/2003 | Schneider | A47C 20/08 248/157 |
| 2003/0079290 | A1 | 5/2003 | Dewert | A47C 20/041 5/618 |
| 2012/0019037 | A1* | 1/2012 | Rohnert | B60N 2/0831 297/378.1 |
| 2014/0020179 | A1 | 1/2014 | Brougham | A61B 6/0407 5/601 |
| 2014/0191553 | A1* | 7/2014 | Blendea | B60N 2/20 297/354.1 |
| 2014/0306479 | A1* | 10/2014 | Abe | B60N 2/3013 296/65.09 |
| 2015/0074908 | A1* | 3/2015 | Dewert | A47C 20/041 5/616 |
| 2016/0037937 | A1 | 2/2016 | Dewert | A47C 1/0242 5/616 |
| 2016/0157623 | A1 | 6/2016 | Dewert | A47C 17/16 5/616 |

FOREIGN PATENT DOCUMENTS

| | | | |
|---|---|---|---|
| DE | 3409223 | A1 | 9/1985 |
| DE | 3842078 | A1 | 7/1989 |
| DE | 3900384 | C1 | 10/1990 |
| DE | 29602947 | U1 | 8/1996 |
| DE | 29714746 | U1 | 11/1997 |
| DE | 19729282 | A1 | 1/1998 |
| DE | 29811566 | U1 | 1/1998 |
| DE | 69507158 | T2 | 9/1999 |
| DE | 19843259 | C1 | 12/1999 |
| DE | 10017979 | A1 | 6/2001 |
| DE | 10017989 | A1 | 10/2001 |
| DE | 10 2006 017972 | A1 | 10/2007 |
| DE | 102008028586 | A1 | 12/2009 |
| EP | 0372032 | A1 | 6/1990 |
| EP | 0788325 | A1 | 5/1996 |
| EP | 1020171 | A1 | 7/2000 |
| EP | 1294255 | B1 | 3/2003 |
| EP | 1633219 | A1 | 12/2004 |
| EP | 2878230 | A1 | 6/2015 |
| FR | 2727296 | A1 | 5/1996 |
| GB | 2334435 | A | 8/1999 |
| SE | 501634 | C2 | 4/1995 |
| WO | WO 9629970 | A1 | 10/1996 |
| WO | WO 00/16663 | A1 | 3/2000 |
| WO | WO 2008113401 | A1 | 9/2008 |

* cited by examiner

ELECTROMOTIVELY ADJUSTABLE SUPPORT APPARATUS, SUCH AS A SUPPORT DEVICE ADJUSTABLE BY AN ELECTRIC MOTOR

CROSS-REFERENCE TO RELATED APPLICATIONS

This application claims priority of German Patent Application No. 10 2014 115 033.3, filed Oct. 16, 2014, and this application claims priority of German Application No. 10 2014 110 114.6, filed Jul. 18, 2014, and each of which is incorporated herein by reference.

FIELD OF THE INVENTION

The invention relates to an electromotively adjustable support apparatus. More particularly, the invention relates to an electromotively adjustable support apparatus for supporting padding of seating and/or reclining furniture. Even more particularly, the invention relates to a support device adjustable by an electric motor for padding of seating and/or reclining furniture such as a mattress of a bed, and which is adjustable by an electric motor.

BACKGROUND OF THE INVENTION

Support apparatuses of this type are generally known, for example in the form of slatted frames.

For adjusting slatted frames, for example, so-called double drives are known which have a housing, designed as a separate component which is connectable to the slatted frame, and in which two adjustment units are accommodated, one of which is used, for example, for adjusting a back support part, and the other, for adjusting a leg support part of the slatted frame. In the known double drives, the adjustment units are designed as a spindle drive, the drive coupling taking place at a support part, which is to be adjusted, via a coupling lever which is connected in a rotationally fixed manner to a pivot shaft which is associated with the support part to be adjusted. For adjusting the support part, the spindle nut of the spindle drive presses against the coupling lever, so that the pivot shaft, and thus the support part, swivels. Double drives of this type are known from EP 0372032 A1 and DE 3842078 A1, for example.

A furniture drive designed as a double drive is known from both DE 10017989 C2 and DE 10017979 C2, in which each adjustment unit has an electromotively driven winding device for a traction means, in the form of a cable, belt, or chain, which is connected in the manner of a pulley block to a pivot lever which is connected in a rotationally fixed manner to a pivot shaft, which in turn is in operative connection with a support part to be adjusted.

Furniture drives which operate according to a similar principle are also known from DE 3409223 C2, DE 19843259 C1, and EP 1020171 A1.

Furthermore, double drives which operate according to different principles are known from DE 19729282 A1, DE 29811566 U1, and DE 29714746 U1.

An adjustable slatted frame is known from DE 3900384 in which the adjustment of a head support part or leg support part of the slatted frame takes place by means of a pneumatic cylinder.

A gas spring adjustment fitting for slatted frames is known from DE 29602947 U1, in which a cable pull is provided for actuating the gas spring.

A slatted frame is known from DE 3103922 A1 in which the adjustment of an upper body support part, for example, takes place via a windshield wiper motor and a scissor lift.

A double drive is known from EP 1294255 B1 in which the transmission of force from a linear movable drive element to a pivot lever, which is in operative connection with a pivot shaft that is in operative connection with a support part to be adjusted, takes place via a pulley block. Similar furniture drives are also known from FR 2727296, DE 3409223 C2, DE 19843259 C1, GB 2334435, and U.S. Pat. No. 5,528,948.

In addition, slatted frames are known in which the adjustment apparatus for adjusting a support part is partially or completely integrated into a base body of the slatted frame. In this sense, DE 19962541 C2 (corresponding to EP 1239755 B1, JP 2001-546280, and U.S. Pat. No. 6,754,922) discloses and describes an electromotively adjustable support apparatus having a first support part which has mutually parallel longitudinal beams, and which in the support apparatus known from the cited publication is formed by a stationary center support part. The known support apparatus also has further support parts, which are adjustable relative to the first support part by a drive means. In the support apparatus known from the cited publication, a first longitudinal beam of the first support part for accommodating the drive means is designed as a hollow profile, wherein the entire drive, including a drive motor, is accommodated in the hollow longitudinal beam. For this reason, the drive motor does not protrude beyond the first longitudinal beam in the vertical direction thereof, so that the support apparatus known from the cited publication has an extremely small installation height. A similar support apparatus is also known from DE 10046751 (corresponding to EP 1239754 B1, JP 2001-547994, and U.S. Pat. No. 6,961,971).

A motor-adjustable support apparatus for a mattress of a bed is known from WO 96/29970, having multiple support parts, following one another in the longitudinal direction of the support apparatus, which are pivotable relative to a first support part via a drive means. The support parts are supported on an outer frame whose profile height is significantly greater than the profile height of the support parts. In the support apparatus known from the cited publication, portions of the outer frame are designed as a hollow profile, and portions of the drive means for adjusting the support parts relative to one another are accommodated in the hollow profile. The drive motor is situated on an inner side of a portion of the outer frame.

A motor-adjustable support apparatus for a mattress of a bed is known from DE 69507158 T2 (corresponding to EP 0788325 B1), having a first support part which has a longitudinal beam, and at least one second support part which is pivotable relative to the first support part via a drive means. In the known support apparatus, the drive motor is situated outside the base area of the support apparatus and is fastened to a frame-like extension of the first support part.

A slatted frame is known from EP 1633219 B1, in which portions of the adjustment apparatus are accommodated in a hollow longitudinal beam, while the drive motor is situated outside the longitudinal beam, and through a recess is in drive connection with the portions of the adjustment apparatus accommodated in the longitudinal beam.

A furniture drive which is provided for adjusting a drawer relative to a body of a cabinet is known from WO 2008/113401, in which the adjustment of the drawer takes place via a flexible toothed rack which is in engagement with a gearwheel.

A slatted frame having an integrated adjustment apparatus is known from DE 10 2008 028586 A1, in which the transmission of force from drive motors of the adjustment apparatus to the support parts to be adjusted takes place via pull cables which are guided over deflection points.

Electromotively adjustable slatted frames generally have an adjustment fitting which is used to transmit the adjustment force from an electric motor or multiple electric motors to the mutually adjustable support parts of the slatted frame. For installing an electromotively adjustable slatted frame, for example a double drive is mounted on the slatted frame in such a way that the adjustment elements of the double drive enter into operative connection with the adjustment fitting of the slatted frame.

OBJECTS AND SUMMARY OF THE INVENTION

An object of the invention is to provide an electromotively adjustable support apparatus, which has a minimal installation height and is suitable for applying large adjustment forces.

This object is achieved by the invention as set forth herein.

This object is further achieved by an electromotively adjustable support apparatus for supporting padding of seating and/or reclining furniture, in particular a mattress of a bed, having at least two support parts which are adjustable relative to one another, wherein an adjustment element is associated with at least one support part for adjusting the support part, the adjustment element being in drive connection with an electric motor of a drive unit characterized in that the adjustment element is a pivot lever which is pivotable under the traction effect of a pull cable of a Bowden cable, and which is designed and in operative connection with the pull cable in such a way that the length of the lever arm which is operative for adjusting the support part changes during an adjustment between an unadjusted starting position and a maximally adjusted end position of the support part.

The invention is based on the finding that during the adjustment of support apparatuses it may be advantageous when the adjustment force exerted on a support part to be adjusted during the adjustment movement changes during the adjustment. If the support apparatus, for example, is a slatted frame on which a mattress rests, the mattress is elastically and flexibly deformed during the adjustment of a back support part of the slatted frame. With increasing deformation of the mattress, the restoring forces, which seek to return the mattress to its original shape, increase significantly. This is true in particular when the mattress is a so-called box spring mattress. As a result, these restoring forces must be overcome by the electric motor drive unit. Since the restoring forces increase at the end of the adjustment movement, i.e., when the mattress is maximally deformed, it may accordingly be desirable to increase the adjustment forces in particular toward the end of the adjustment movement.

On this basis, the invention is based on the concept of designing, i.e., configuring, the support apparatus in such a way that a change in the adjustment force during the adjustment movement is possible.

The invention provides that the adjustment element is a pivot lever which is pivotable under the traction effect of a pull cable of a Bowden cable, and which is designed and in operative connection with the pull cable in such a way that the length of the lever arm which is operative for adjusting the support part changes during an adjustment movement between an unadjusted starting position and a maximum end position of the adjustment movement.

It is thus possible, for example and in particular, to apply a larger adjustment force in the area of a maximally adjusted end position than in the area of an unadjusted starting position. In this way, even for box spring mattresses, for example, a maximum end position of the adjustment movement may be achieved under the additional load of a person lying on the mattress.

The basic principle according to the invention may be advantageously realized, for example, by designing the pivot lever as a curved body which is pivotably connected to the support part to be adjusted, and which rolls on a support during the adjustment movement. In this regard, the length of the lever arm which is operative for adjusting the support part is defined by the distance of the pivot axis, about which the pivot lever is pivotably connected to the support part to be adjusted, from the point at which the curved body rests on the support. By appropriate shaping of the curved body, any given suitable course of the adjustment force may thus be achieved during the adjustment movement.

According to the invention, the support per se may in principle also be designed as a curved body. For configuring the support in a particularly simple and cost-effective way, one advantageous further embodiment of the invention provides that the support is designed as an essentially flat surface.

Another advantageous further embodiment provides that the support is formed on a lug which is connected to an outer frame of the support apparatus. For example and in particular, the lug may be designed as a bracket whose one leg is connected to the outer frame, for example by screwing, and whose other leg forms the support.

Instead of providing the pivot lever itself as the curved body, the basic principle of the invention may also be advantageously embodied by guiding the pull cable of the Bowden cable around a curved body which is in pivot drive connection with the pivot lever. In this embodiment, the lever arm which is operative for adjusting the support part is defined by the curved body, which in turn may be shaped in such a way that a desired course of the adjustment force, and thus of the adjustment torque, results during the adjustment movement.

In the above-mentioned embodiment, the pivot drive connection between the curved body and the pivot lever may be established, for example, via a gear. To design the structure in a particularly simple and cost-effective manner, one advantageous further embodiment provides that the curved body is connected in a rotationally fixed manner to the pivot lever.

One particularly advantageous further embodiment provides that the curved body is designed in one piece with the pivot lever. In this embodiment, the pivot lever and the curved body may be formed, for example, by an injection-molded part made of plastic.

Another advantageous further embodiment of the invention provides that the end of the sheathing of the Bowden cable facing the curved body is held on a holding part which is supported so as to be pivotable about a pivot axis in such a way that the sheathing follows changes in direction of the pull cable in the peripheral direction of the pivot axis. If the direction of the pull cable changes during the adjustment movement due to the shape of the curved body, the movable bearing of the holding part prevents the pull cable from stressing the sheathing in its radial direction and thus damaging it. Since the sheathing follows changes in direction of the pull cable, the sheathing yields as soon as the pull cable exerts a force acting on the sheathing in the radial direction. Damage to the sheathing is thus reliably avoided.

A further embodiment of the above-mentioned embodiment provides that the pivot axis of the holding part is parallel to the pivot axis of the pivot lever.

The invention is explained in greater detail below based on various embodiments, with reference to the appended drawings. All features which are described, and illustrated in the drawings, alone or in any suitable combination with one another, constitute the subject matter of the present invention, regardless of their wording or illustration in the summary, description or drawings, respectively.

Relative terms such as left, right, up, and down are convenience only and are not intended to be limiting.

DETAILED DESCRIPTION OF THE INVENTION

First, the basic mode of operation of an electromotively adjustable support apparatus is explained below with reference to FIGS. 1 to 14, in which the adjustment is effected via Bowden cables.

A person having ordinary skill in the art will readily understand that an electromotively adjustable support apparatus includes an apparatus which is adjustable by an electric motor.

Figure 1:
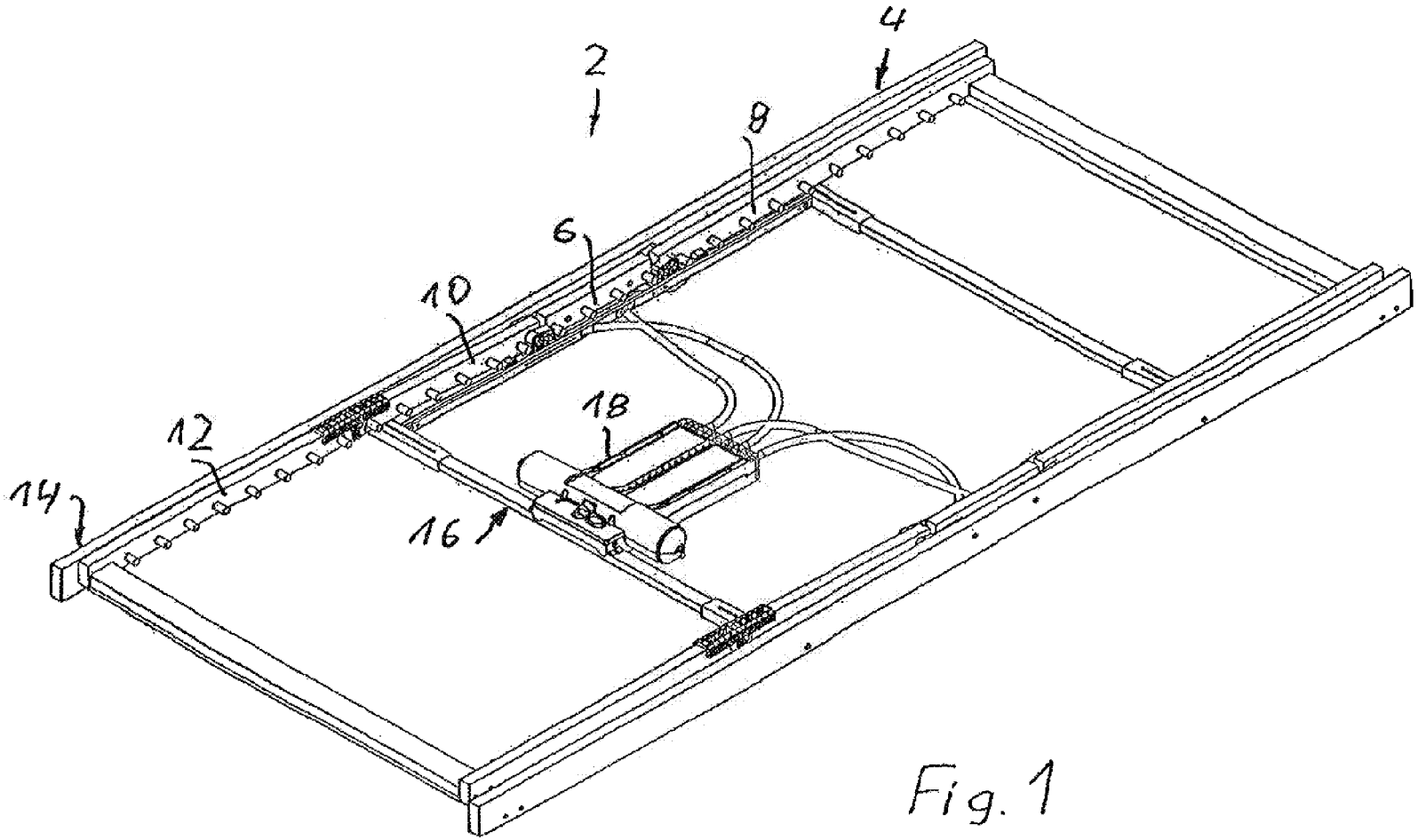
FIG. 1 shows in a perspective view one preferred embodiment of an electromotively adjustable support apparatus in the form of a slatted frame, in an unadjusted position.

FIG. 1 illustrates in a perspective illustration one preferred embodiment of an electromotively adjustable support apparatus for padding of seating and/or reclining furniture, in particular a mattress of a bed, in this embodiment the support apparatus being designed, i.e., configured, as a slatted frame 2. For the sake of clarity, elastic slats of the slatted frame 2, for example resilient wooden strips, are not illustrated in the drawing. However, the design and attachment of these types of elastic slats are generally known to those skilled in the art and therefore are not explained in greater detail.

The slatted frame 2 has a base body or base 4 on which support parts which are adjustable relative to one another are situated. In the illustrated embodiment, the support parts have a stationary center support part or first support part 6, one end of which is articulatedly connected to an upper body support part or second support part 8 and pivotable about a horizontal pivot axis. The end of the center support part 6 facing away from the upper body support part 8 is articulatedly connected to a support part 10 and pivotable about a horizontal pivot axis, and the end of the support part 10 facing away from the center support part 6 is articulatedly connected to a calf support part 12 and pivotable about a horizontal pivot axis.

In the illustrated embodiment, the base body of the slatted frame 4 has an outer frame 14.

The support parts 6 to 12 are connected to the outer frame 14 via a mounting frame 16, on which a drive unit 18 and adjustment elements which are or may be acted on by the drive unit with an adjustment force are situated for acting with an adjustment force on a support part to be adjusted, in a mounting position of the mounting frame 16. The mounting frame 16 is explained in greater detail below with reference to FIGS. 2 to 4. The drive unit 18 is explained in greater detail below with reference to FIGS. 5 and 6. In the illustrated embodiment, adjustment elements of the mounting frame 16 are formed by raising levers, which are explained in greater detail below with reference to FIGS. 7 to 10.

Figure 2:
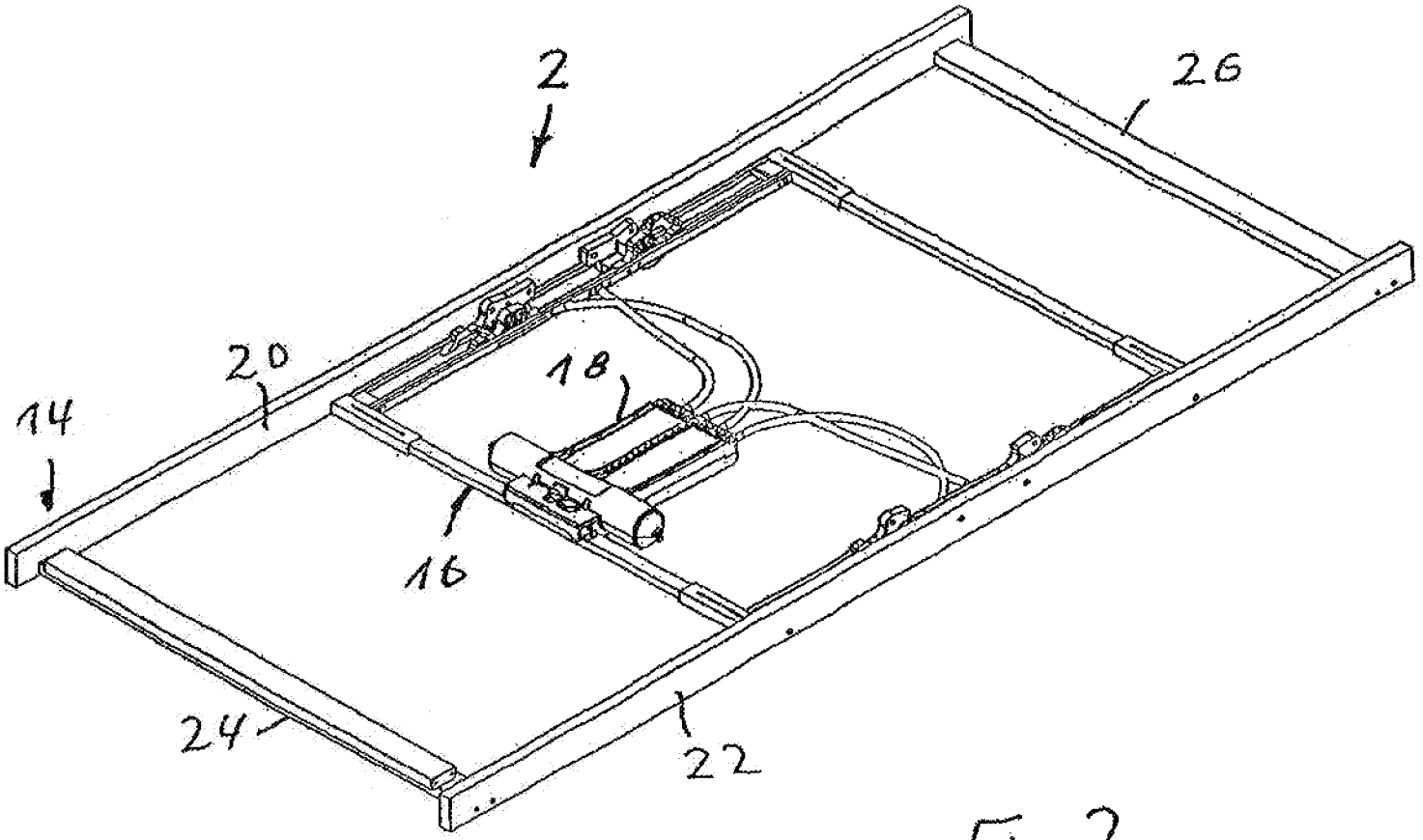
FIG. 2 shows, in the same manner as FIG. 1, the slatted frame according to FIG. 1, with support parts of the slatted frame omitted for the sake of clarity.

FIG. 2 shows the outer frame 14 of the slatted frame 2 with a mounting frame 16 fastened thereto, the support parts 6 to 12 being omitted in FIG. 2 for the sake of clarity. As is apparent from FIG. 2, the outer frame 14 has longitudinal beams 20, 22 at a lateral distance from one another and extending in the longitudinal direction of the slatted frame 2, and which are connected to one another in the area of their ends via transverse beams 24, 26. In the context of the invention, the longitudinal direction of the slatted frame 2 is defined as the direction along which the slatted frame 2 has the larger extension. Accordingly, the transverse direction of the slatted frame 2 is defined as the direction along which the slatted frame 2 has the smaller extension.

Figure 3:
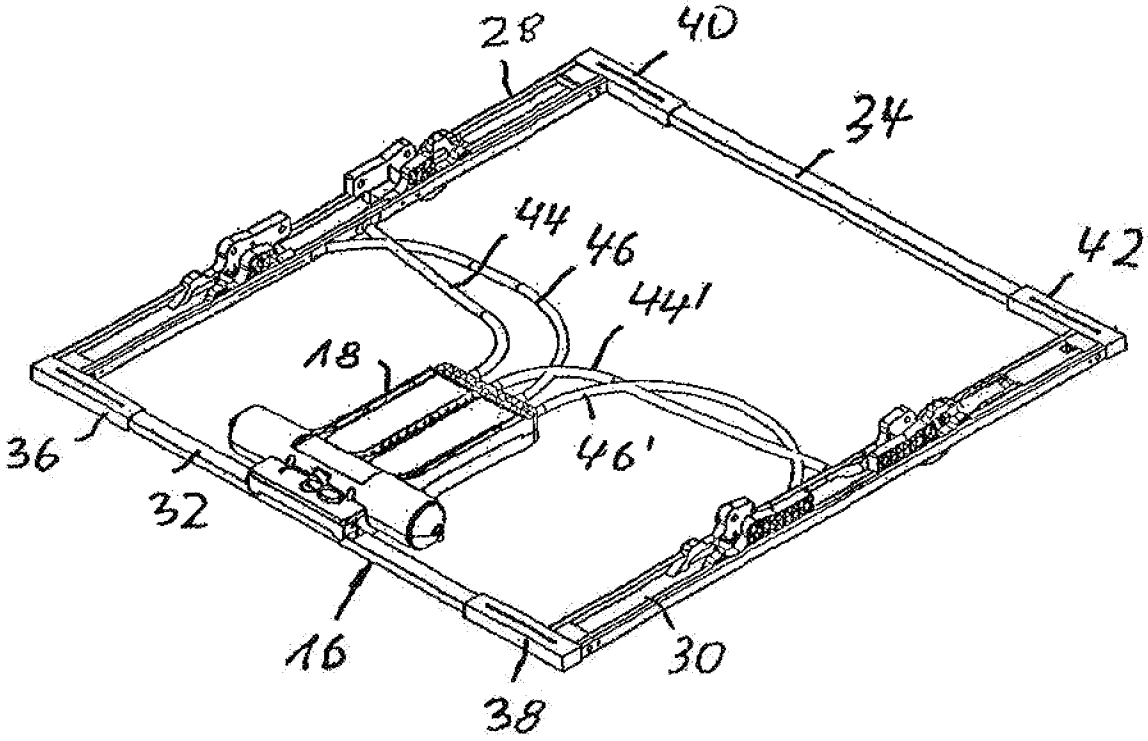
FIG. 3 shows, in the same manner as FIG. 1, a mounting frame of the support apparatus according to FIG. 1.

FIG. 3 shows the mounting frame 16 by itself, i.e., independently of the slatted frame 2. The mounting frame 16 has longitudinal beams 28, 30 which are connected to one another in the area of their ends via transverse beams 32, 34. In the illustrated embodiment, the transverse beams 32, 34 are each formed by a profile rail having the cross section of a horizontal letter "C," and are situated or guided in the adjustment elements of the mounting frame 16, as explained in greater detail below with reference to FIG. 11.

In the illustrated embodiment, the mounting frame 16 has a width-adjustable design for adapting to slatted frames of different widths. For achieving the width adjustability, telescoping elements 36, 38 and 40, 42, which in the illustrated embodiment are designed as tube parts and extend at right angles to the longitudinal beams 28 and 30, are each situated on the longitudinal beams 28, 30 of the mounting frame 16, extending toward the respective other longitudinal beam 30, 28. In the illustrated embodiment, the ends of the transverse beam 32 are guided in a telescoping manner into the telescoping elements 36, 38. The ends of the transverse beam 34 are correspondingly guided in a telescoping manner into telescoping elements 40, 42.

In the illustrated embodiment, the drive unit 18 is situated on the transverse beam 32, and is displaceable in the beam direction of the transverse beam 32 and lockable in the respective position.

For transmitting force from electric motors of the drive unit 18 to the support parts 6 to 12 to be adjusted, in the illustrated embodiment Bowden cables 44, 44' and 46, 46' are provided which are each associated with an adjustment element. The cooperation of the Bowden cables 44, 44', 46, 46' with the drive unit 18 and the adjustment elements is explained in greater detail below with reference to FIGS. 5 to 7.

For installing the mounting frame 18 on the outer frame 14 of the slatted frame 2, initially the width of the mounting frame 16 (see FIG. 3) is set corresponding to the width of the outer frame 14 (see FIG. 2) of the slatted frame 2. In particular, the longitudinal beams 28, 30 of the mounting frame 16 are pulled apart far enough that the spacing of the outer surfaces of the longitudinal beams 28, 30 of the mounting frame corresponds to the inside width between the inner surfaces of the longitudinal beams 20, 22 of the outer frame 14. The transverse beams 32, 34 of the mounting frame 16 thus slide into the telescoping elements 36, 38 and 40, 42, respectively. After the desired width is set, the mounting frame 16 is inserted into the outer frame, as illustrated in FIG. 2. The mounting frame 16 may be subsequently fastened to the outer frame 14, for example by screwing.

After the mounting frame 16 is installed on the outer frame 14, the support parts 6 to 14 of the slatted frame 2 may be connected to the mounting frame 16.

Figure 4:
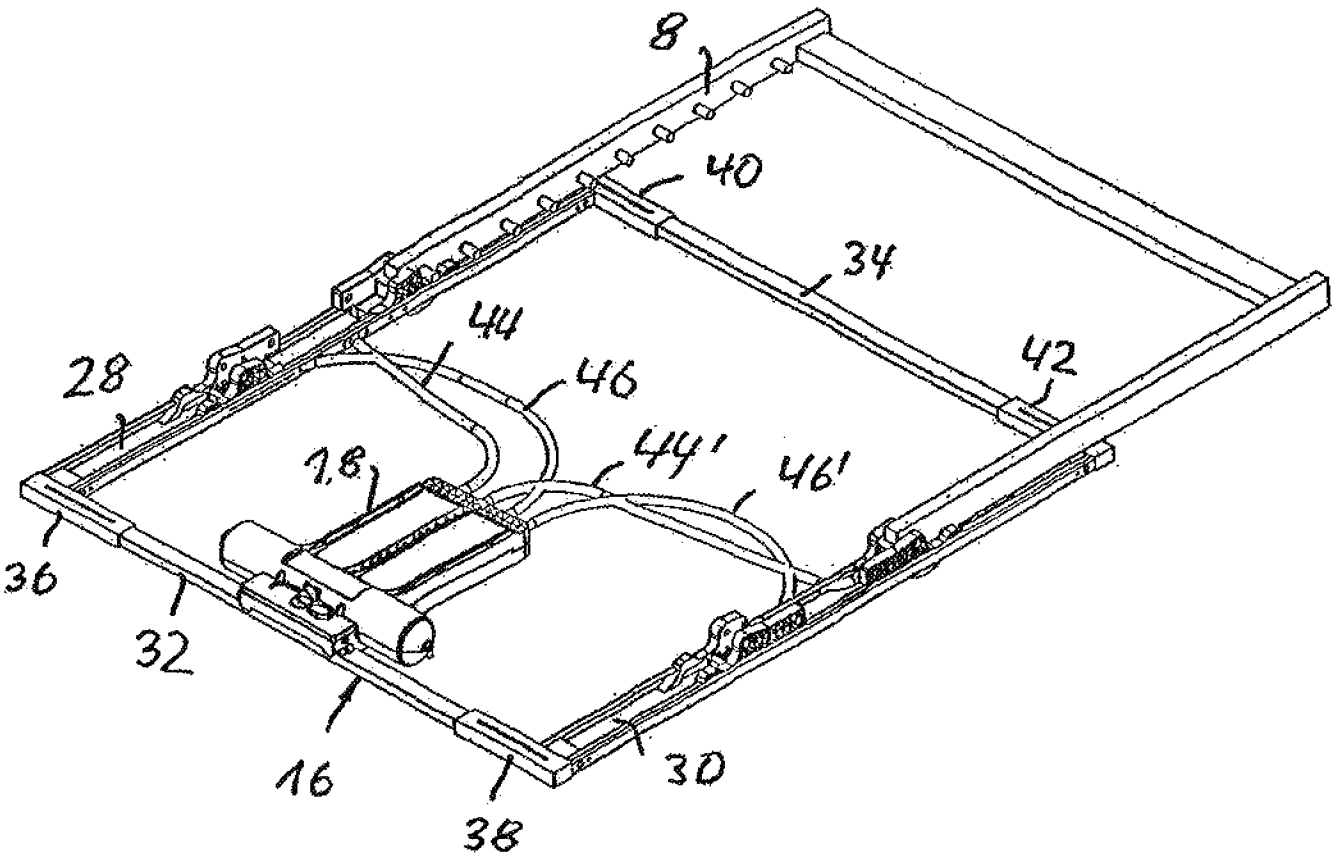
FIG. 4 shows, in the same manner as FIG. 3, the mounting frame according to FIG. 3 together with a support part pivotably supported thereon.

FIG. 4 shows an example of a connection of the upper body support part 8 to the mounting frame 16. The connection of the leg support part 10 in addition to the calf support part 12 which is connected thereto takes place in a corresponding manner, and therefore is not explained here in greater detail. For connecting to the upper body support part 8, a bearing apparatus for pivotably supporting at least one pivotably adjustable support part is formed on the mounting frame, in the illustrated embodiment the bearing apparatus having bearing bushes at a lateral distance from one another, into which the upper body support part 8 is insertable with bearing journals at a lateral distance from one another. FIG.

4 shows the upper body support part 8 pivotably mounted on the mounting frame 16 in this way.

Figure 5:
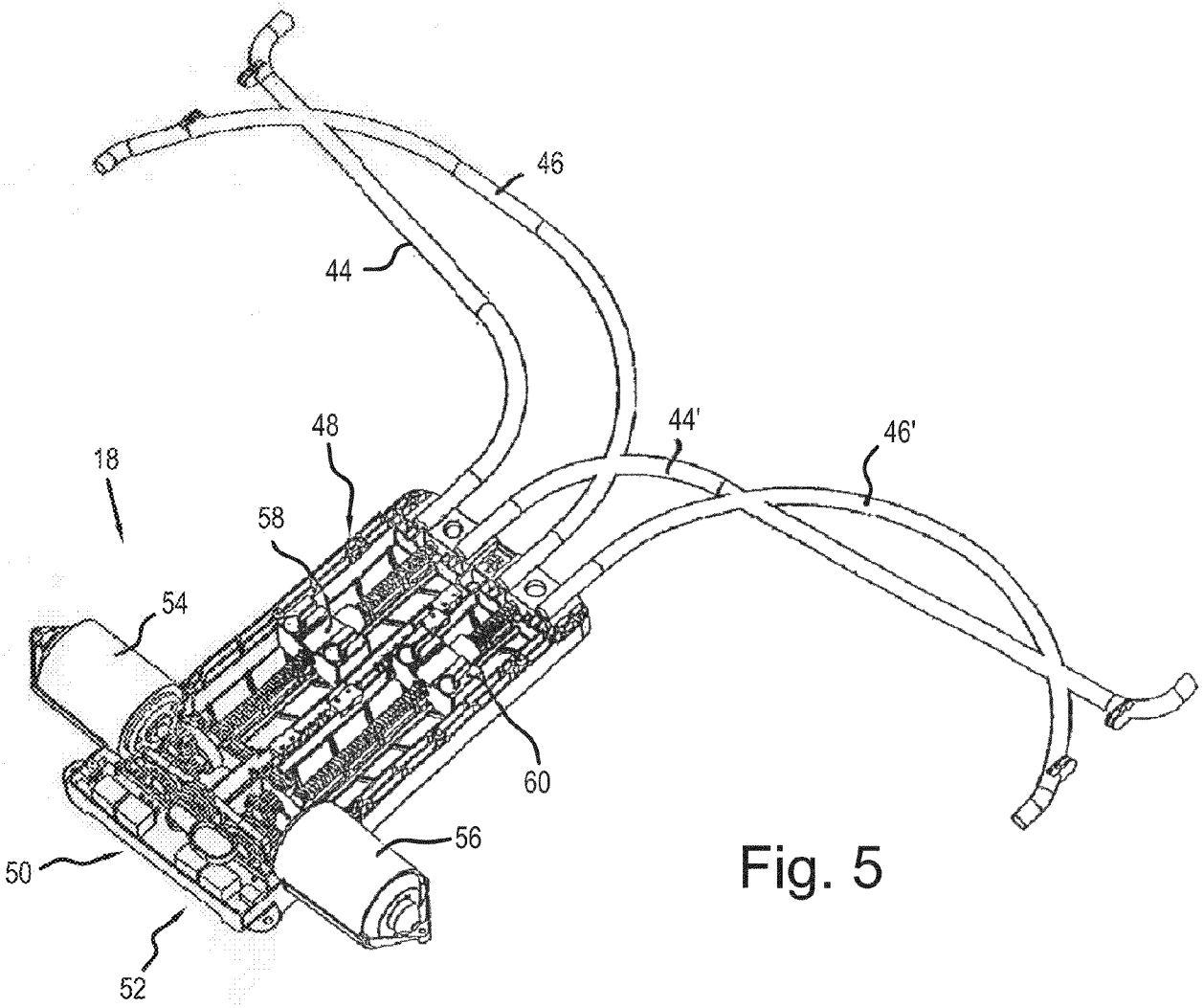
FIG. 5 shows in a perspective illustration a drive unit of the slatted frame according to FIG. 1, with the housing of the drive unit shown open for purposes of illustration, and components of the drive unit omitted for the sake of clarity.

FIG. 5 shows the drive unit 18 in a perspective view, with the housing 48 of the drive unit 18 shown open for purposes of illustration. The drive unit 18 has two drive trains 50, 52 with which an electric motor 54, 56, respectively, is associated, and whose output members are formed by spindle nuts 58, 60, respectively. The sheathings of the Bowden cables 44, 44' and 46, 46' are fixed to the housing 48 of the drive unit 18, while the pull cables of the Bowden cables are fixed in pairs to the spindle nuts 58, 60. In the illustrated embodiment, the pull cables of the Bowden cables 44, 44' are fixed to the spindle nut 58, while the pull cables of the Bowden cables 46, 46' are fixed to the spindle nut 60. The electric motors 54, 56 are controllable independently of one another. The control means for controlling the electric motors 54, 56 is not illustrated in the drawing for reasons of clarity. The same applies for a power supply means, which likewise is not illustrated in the drawing for reasons of clarity.

Figure 6:
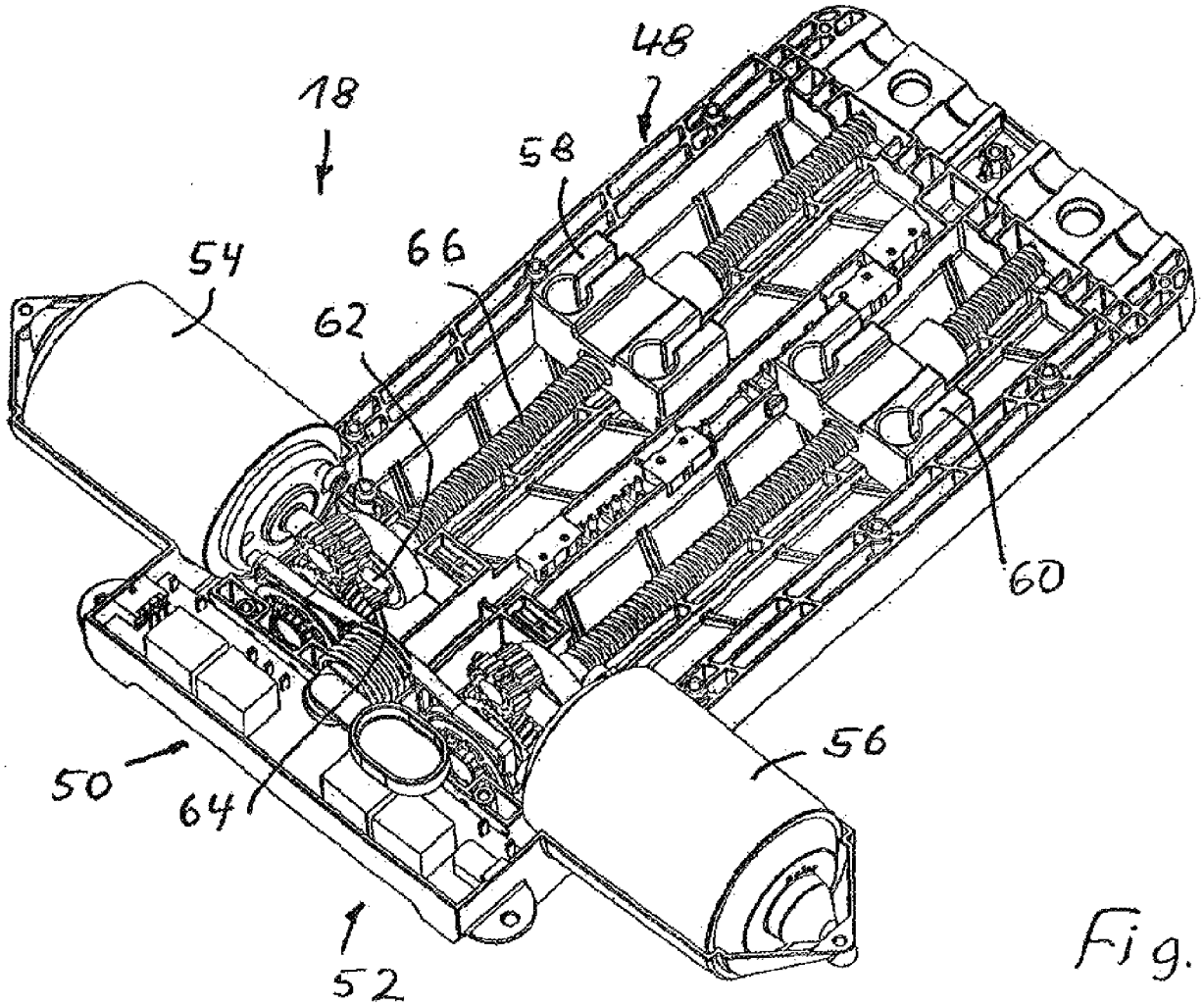
FIG. 6 shows, in the same manner as FIG. 5, the drive unit according to FIG. 5, but in enlarged scale.

FIG. 6 shows the drive unit 18 according to FIG. 5, with the Bowden cables 44, 44' and 46, 46' omitted for reasons of clarity. The drive train 50 and its mode of operation are explained in greater detail below. The drive train 52 has a corresponding construction, and therefore is not explained in greater detail.

The electric motor 54 of the drive train 50 has an output shaft 62, designed as a worm gear of a worm drive, which is in engagement with a worm gear wheel 64 that is connected in a rotationally fixed manner to a threaded spindle 66 rotatably supported in the housing 48. In the illustrated embodiment, the worm gear 62 and the worm gear wheel 64 are components of a gear assembly, which, as is apparent from FIG. 6, has even further gear elements which, however, are not of further interest in the present context and therefore are not explained in greater detail.

The spindle nut 58 to which the Bowden cables 44, 44' (not illustrated in FIG. 6) are fixed is situated on the threaded spindle 66 in a rotationally fixed manner and is movable in the axial direction. For adjusting a support part, the electric motor 54 drives the threaded spindle 66 in such a way that the spindle nut 58 moves to the left in FIG. 6, so that the spindle nut 58 tightens onto the pull cables of the Bowden cables 44, 44'. As explained in greater detail below with reference to FIG. 7, the traction effect on the pull cables of the Bowden cables 44, 44' is converted into a raising movement of a raising lever which forms an adjustment element of the mounting frame 16. A return to the unadjusted position of the slatted frame (see FIG. 1) takes place with the electric motor 54 switched on, but under the weight force of the support part, optionally additionally under the load of a person lying on the slatted frame.

Figure 7A:
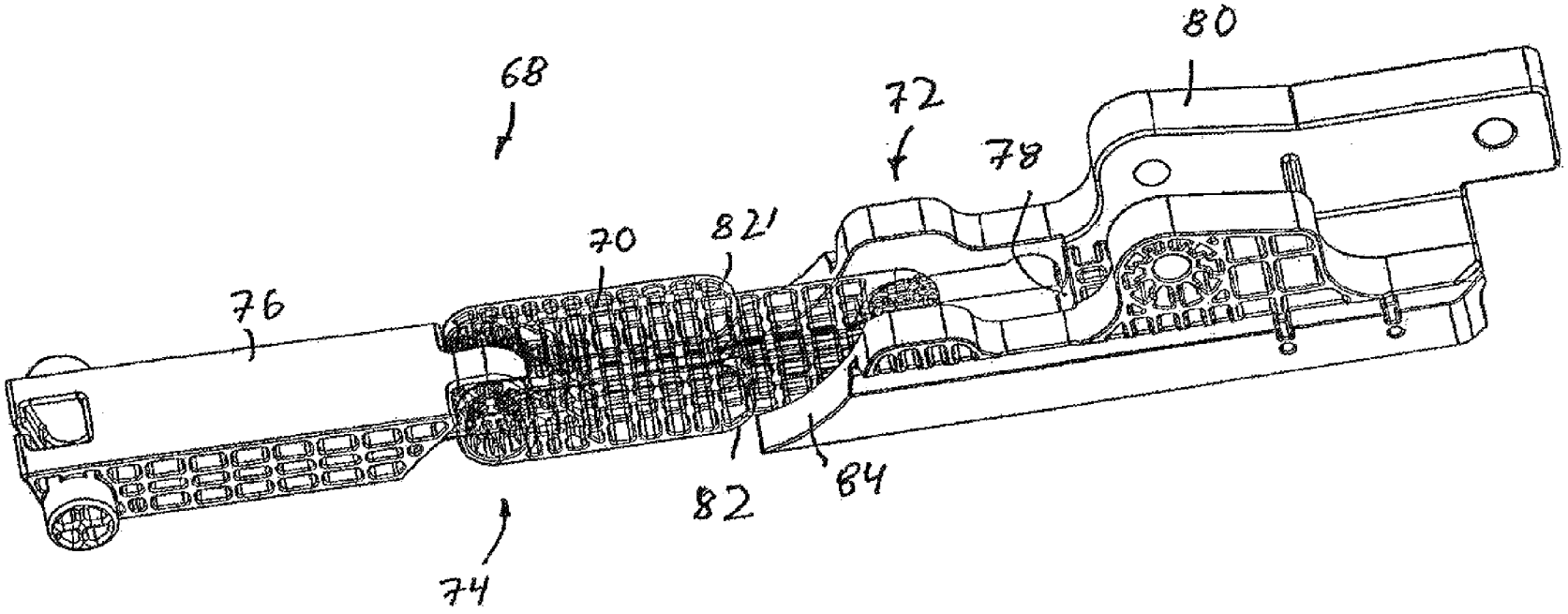
FIG. 7A shows in a perspective view details of an adjustment element of the slatted frame according to FIG. 1 in an adjustment position or kinematic phase.

FIG. 7A shows a raising lever assembly 68 which has a first raising lever 70 which forms the adjustment element of the furniture drive situated on the mounting frame 16 and which is raisable under the traction effect of the pull cable of a Bowden cable—in the illustrated embodiment, under the traction effect of the pull cable of the Bowden cable 44'. The first raising lever 70 is pivotably raisable about a first pivot axis 72, the end of the first raising lever facing away from the first pivot axis 72 being articulatedly connected to a second raising lever 76 and pivotable about a second pivot axis 74 parallel to the first pivot axis 72, the second raising lever being operatively connected to the pull cable of the Bowden cable 44' in such a way that the raising levers 70, 76 rise up under the traction effect of the pull cable of the Bowden cable. In the illustrated embodiment, the pull cable of the Bowden cable, not shown in FIG. 7, is fixed to the end of the second raising lever 76 facing away from the first raising lever 70.

Figure 11A:
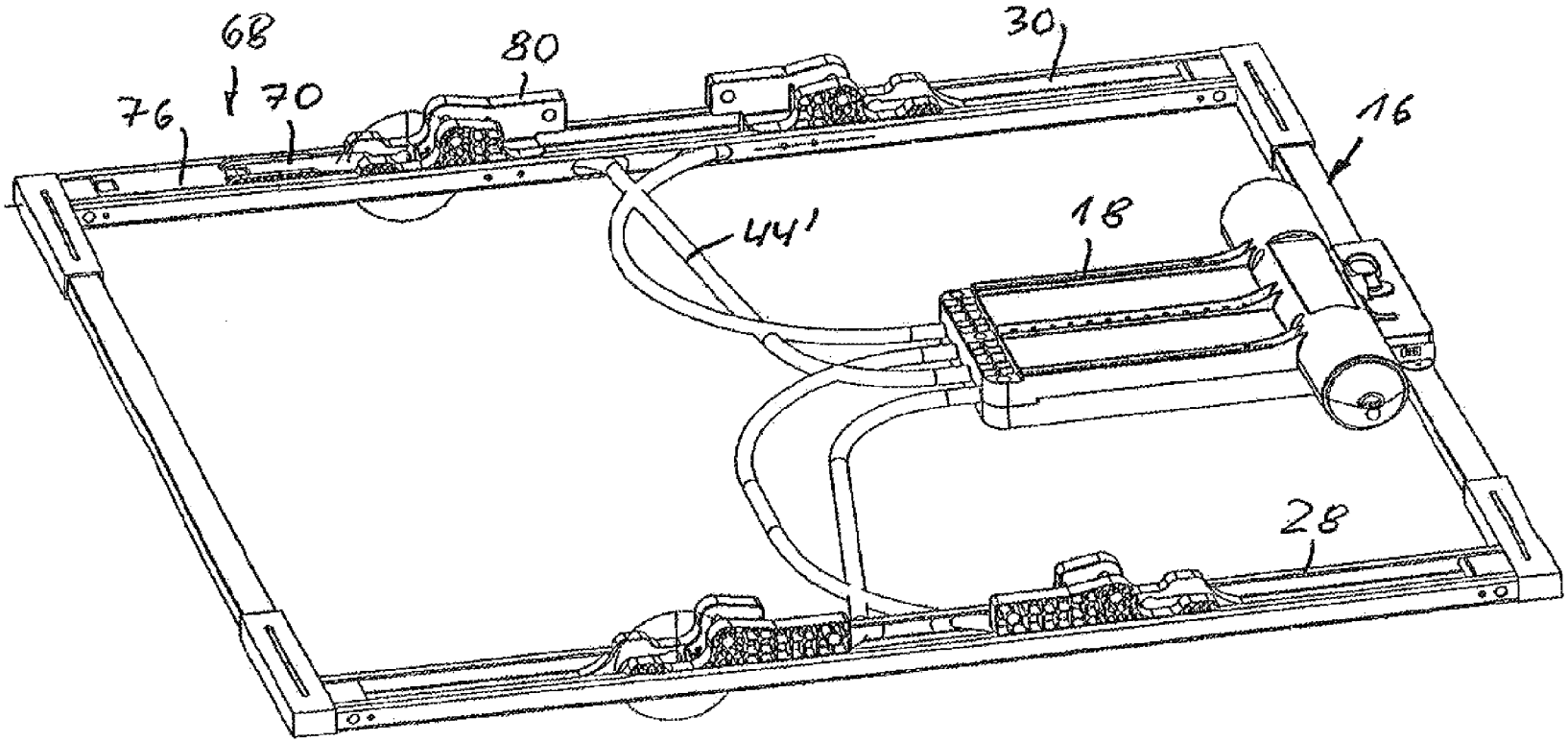
FIG. 11A shows, in a perspective view, the mounting frame according to FIG. 3 in an adjustment position or kinematic phase.

In the illustrated embodiment, a stop 78 which is formed on a stop element 80 that is nondisplaceably connected to the longitudinal beam 30 of the mounting frame 16 is associated with the first raising lever 70 (see FIG. 11A).

The mode of operation of the raising lever assembly 68 is explained in greater detail below, with reference to FIGS. 7A to 7E and FIGS. 11A to 11E. FIGS. 7A to 7E show only the raising lever assembly 68 in combination with the stop element 80, while FIGS. 11A to 11E additionally show the mounting frame 16. In FIGS. 7A to 7E and FIGS. 11A to 11E, figures having the same letter suffix denote the same kinematic phase.

At the start of the adjustment movement, i.e., when the slatted frame 2 is unadjusted, the pivot axes 72, 74 and a force application point of the Bowden cable 44' on the second raising lever 76 lie in one plane, so that the raising lever assembly is translationally displaced to the right in FIG. 7A or 11A under the traction effect of the pull cable of the Bowden cable 74. As is apparent from FIG. 11A, the C-shaped profile of the longitudinal beam 30 of the mounting frame 16 forms a guide for the translational displacement of the raising lever assembly 68. Due to the fact that in the first kinematic phase the first pivot axis 72 and the second pivot axis 74 as well as the force application point of the pull cable of the Bowden cable 44 on the second raising lever 76 lie in one plane, in the first kinematic phase the raising lever assembly 68 is displaced to the right in FIG. 7A or FIG. 11A solely by translation.

At the end of the first kinematic phase, the first raising lever 70 together with thickened areas 82, 82' extending laterally, i.e., in the axial direction of the first pivot axis 72, runs up against a lift guide 84 formed on the stop element 80. In the illustrated embodiment, the lift guide 84 has a curved cross-sectional shape. However, it may also be designed as an inclined plane.

Figure 7B:
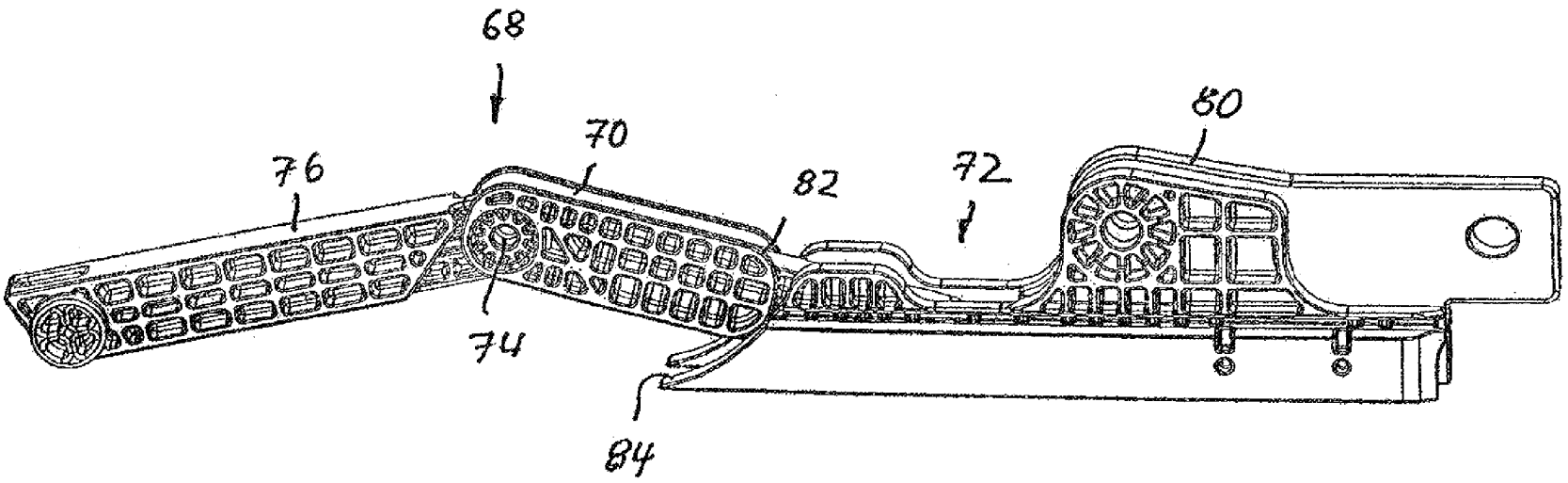
FIG. 7B shows in a further perspective view details of an adjustment element of the slatted frame according to FIG. 1 in another adjustment position or kinematic phase.
Figure 11B:
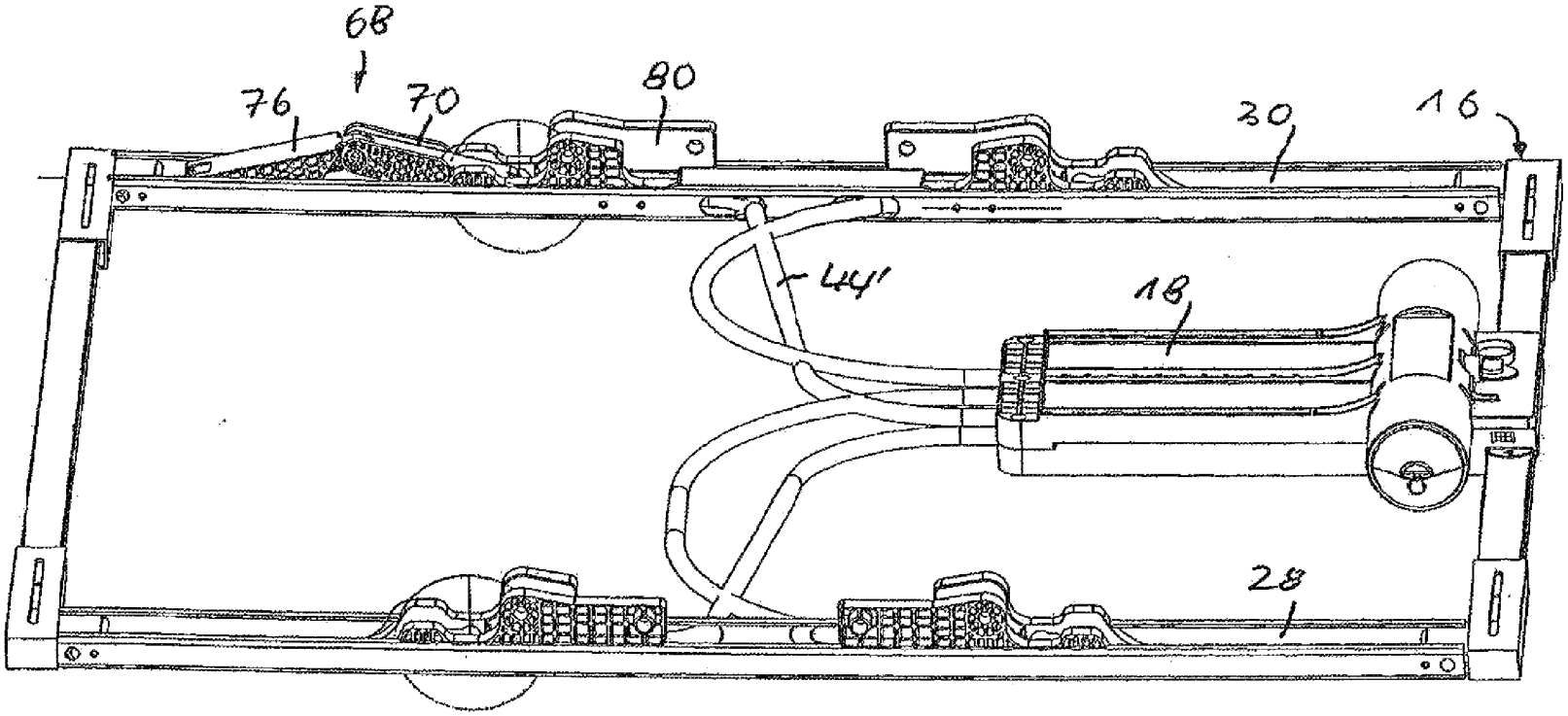
FIG. 11B shows, in a different perspective view, the mounting frame according to FIG. 3 in another adjustment position or kinematic phase.

FIG. 7B illustrates how the end of the first raising lever 70 facing away from the second raising lever 76 runs up against the lift guide 84 and is thus raised, which under the traction effect of the pull cable of the Bowden cable 44' causes the raising levers 70, 76 to rise up. FIG. 11B illustrates the resulting raising of the raising levers 70, 76. As is apparent from FIG. 7B and FIG. 11B, during the second kinematic phase the raising lever assembly 68 simultaneously undergoes a translational movement as well as a raising movement.

Figure 7C:
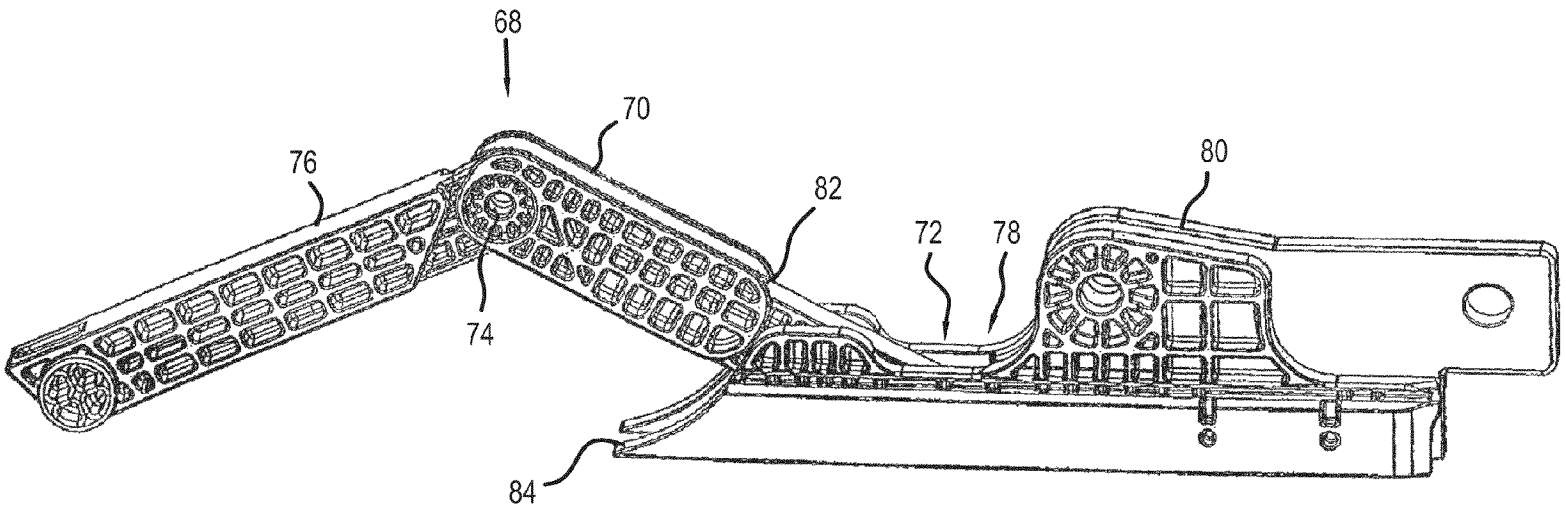
FIG. 7C shows in a further perspective view details of an adjustment element of the slatted frame according to FIG. 1 in another adjustment position or kinematic phase.
Figure 11C:
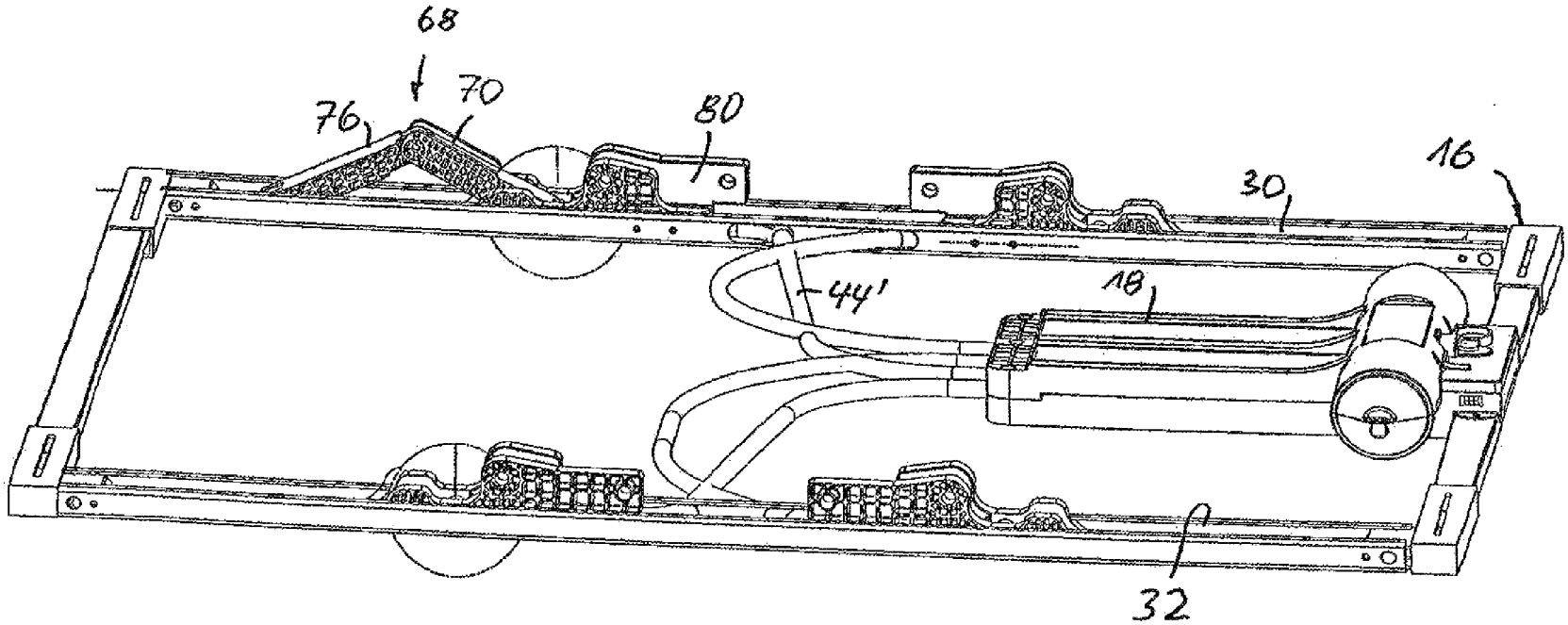
FIG. 11C shows, in a different perspective view, the mounting frame according to FIG. 3 in another adjustment position or kinematic phase.

FIG. 7C and FIG. 11C illustrate the end of the second kinematic phase, in which the free end of the first raising lever 70 facing away from the second raising lever 76 runs up against the stop 78 formed by the stop element 80, so that further translational movement of the raising lever assembly 68 is prevented.

During a subsequent third kinematic phase, the first raising lever 70 undergoes only a raising movement in which it pivots about the first pivot axis 72.

Figure 7D:
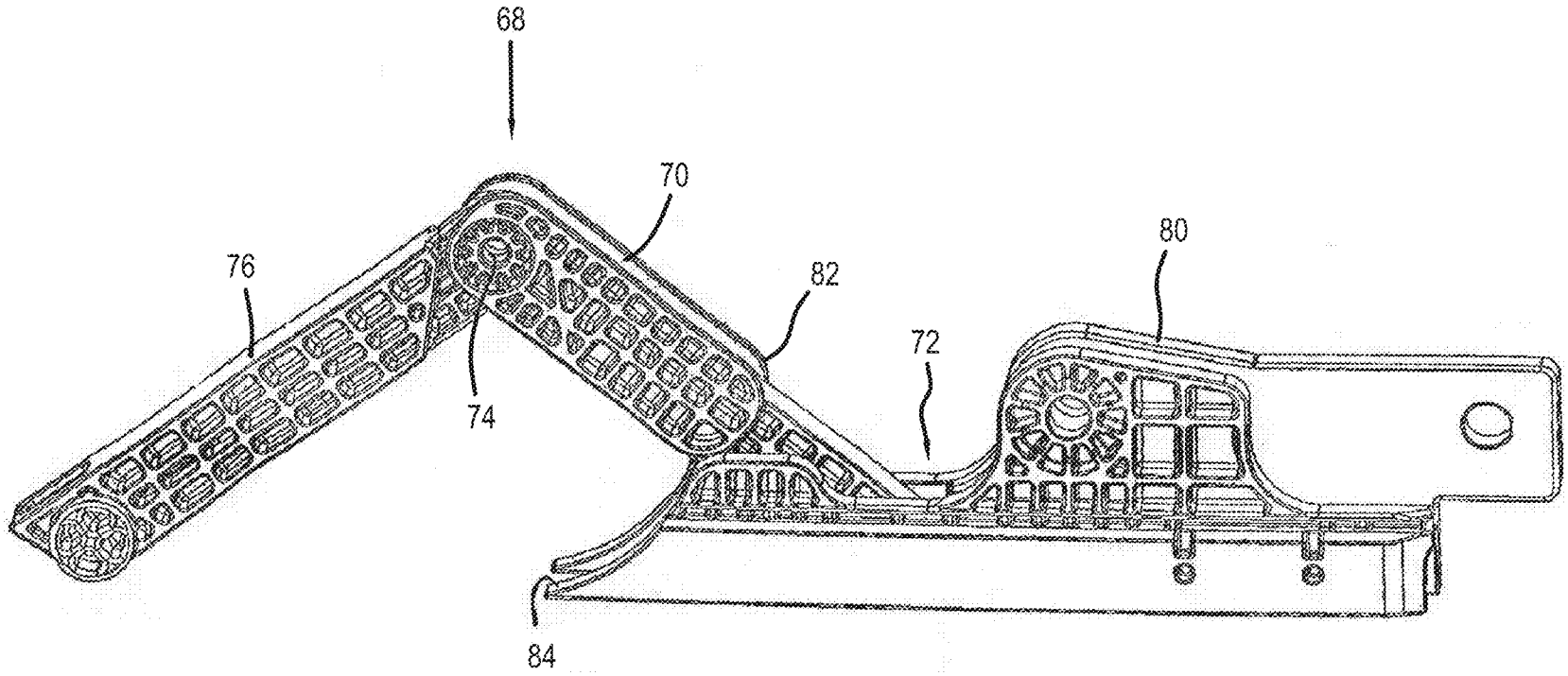
FIG. 7D shows in a further perspective view details of an adjustment element of the slatted frame according to FIG. 1 in another adjustment position or kinematic phase.
Figure 11D:
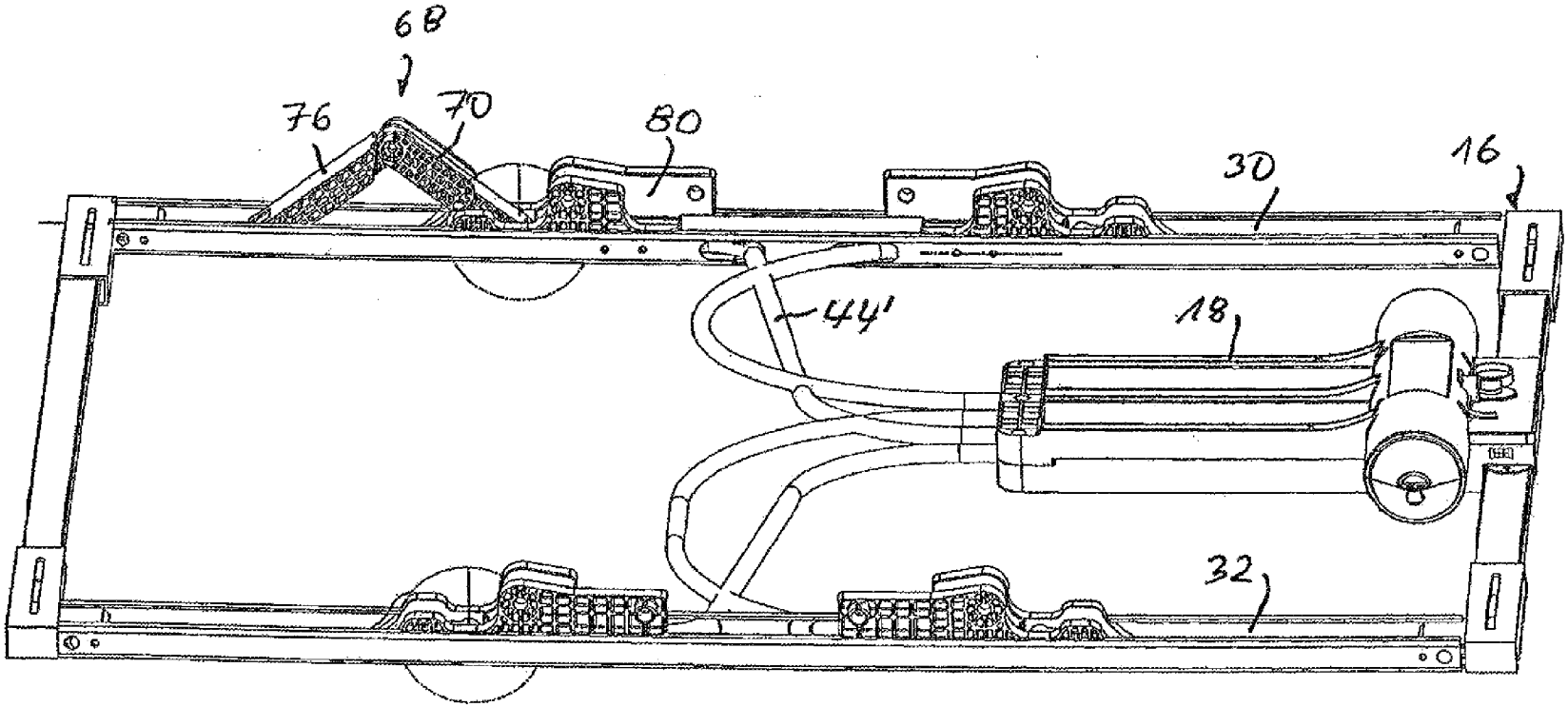
FIG. 11D shows, in a different perspective view, the mounting frame according to FIG. 3 in another adjustment position or kinematic phase.

FIGS. 7D and 11D illustrate the raising lever assembly 68 in the third kinematic phase.

Figure 7E:
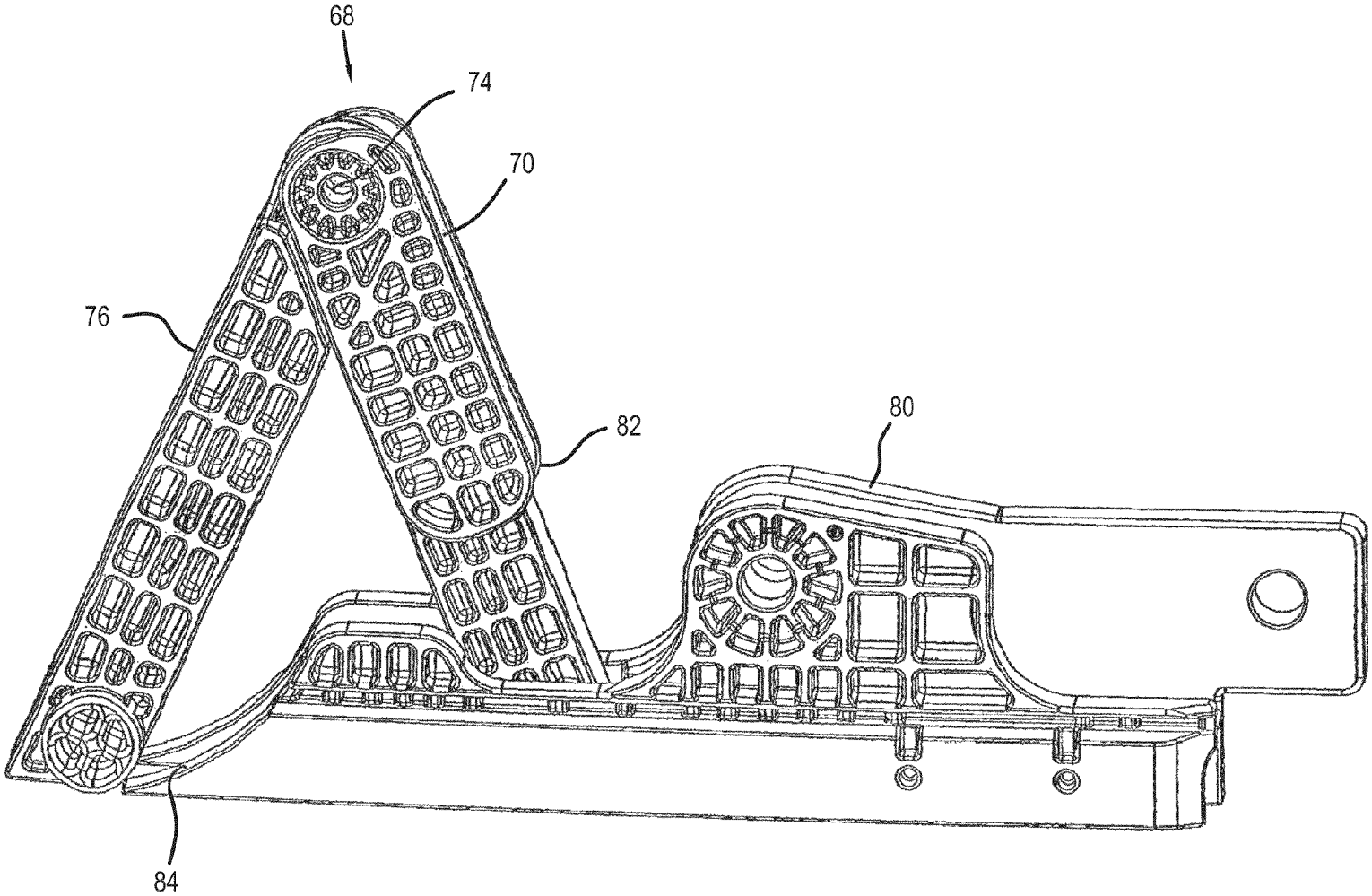
FIG. 7E shows in a further perspective view details of an adjustment element of the slatted frame according to FIG. 1 in another adjustment position or kinematic phase.
Figure 11E:
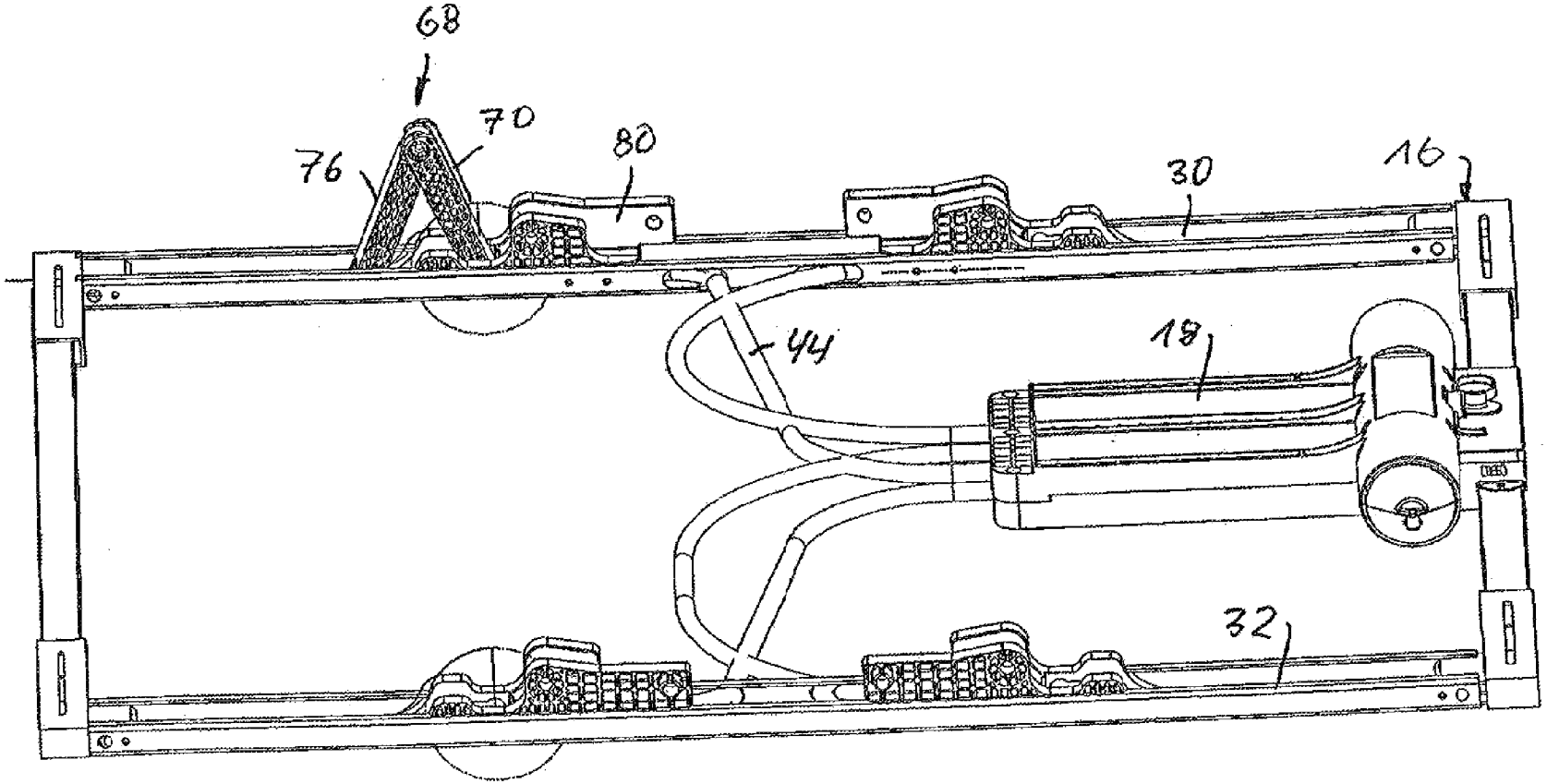
FIG. 11E shows, in a different perspective view, the mounting frame according to FIG. 3 in another adjustment position or kinematic phase.

FIG. 7E and FIG. 11E show the raising lever assembly 68 at the end of the third kinematic phase, in which the raising levers 70, 76 of the raising lever assembly 68 are maximally raised. The position of the raising lever assembly 68 illustrated in FIG. 7E and FIG. 11E corresponds to a maximum adjustment of the upper body support part 8 relative to the center support part 6.

Figure 8:
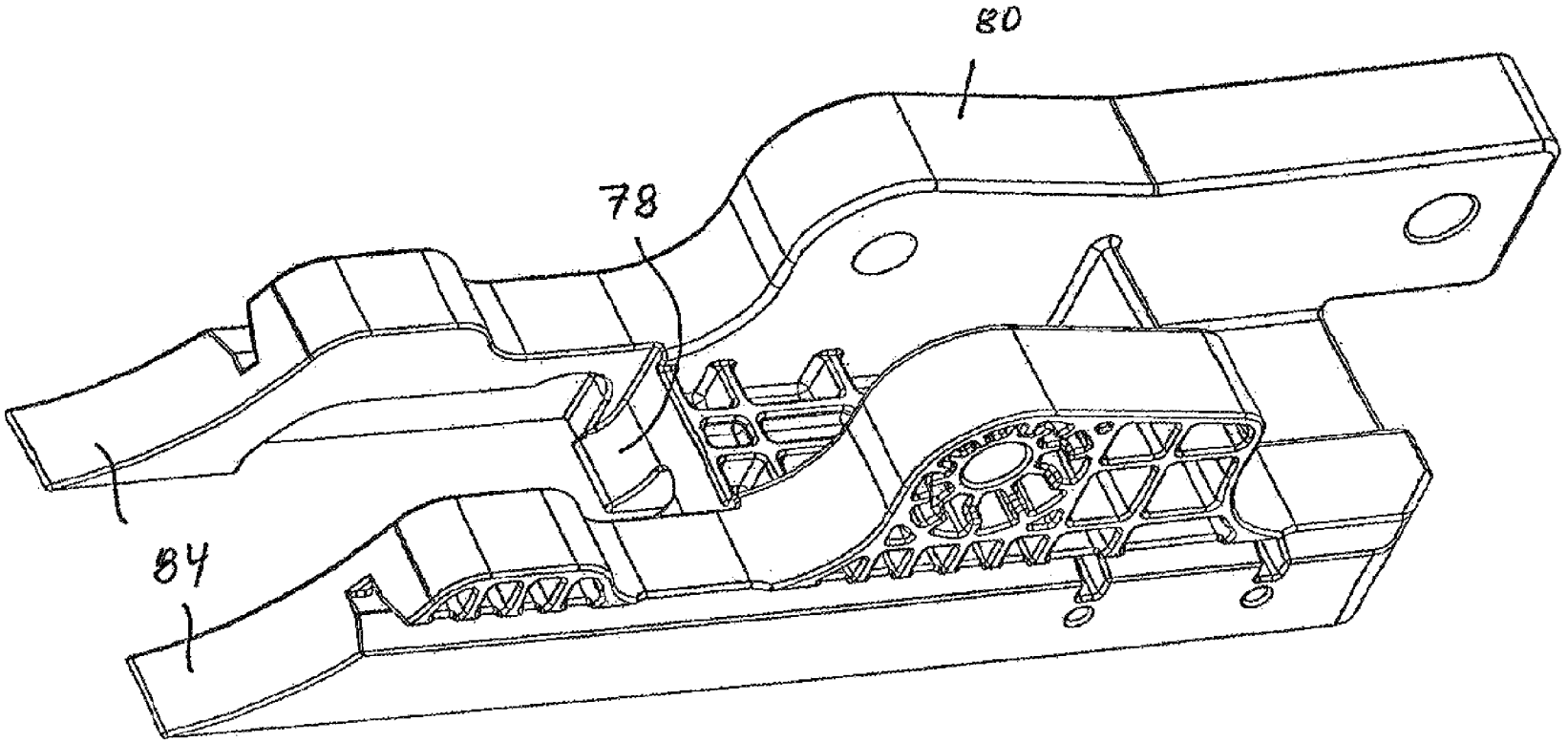
FIG. 8 shows, in a perspective view and in enlarged scale compared to FIG. 7, a stop element of the slatted frame according to FIG. 1.

FIG. 8 shows a perspective view of the stop element 80 by itself, in which the stop 78 is particularly well discernible.

Figure 9:
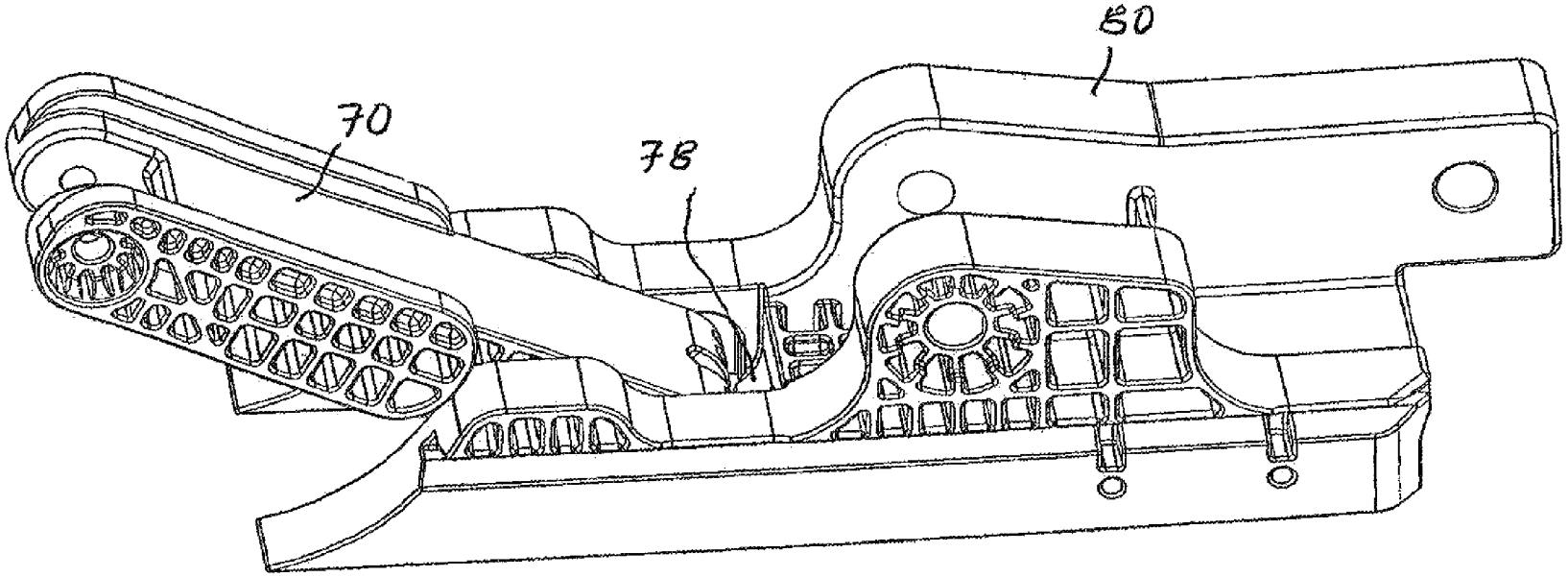
FIG. 9 shows, in the same manner as FIG. 8, the stop element according to FIG. 8 in combination with a raising lever.

FIG. 9 illustrates the free end of the first raising lever 70 running up against the stop 78 at the end of the second kinematic phase.

Figure 10:
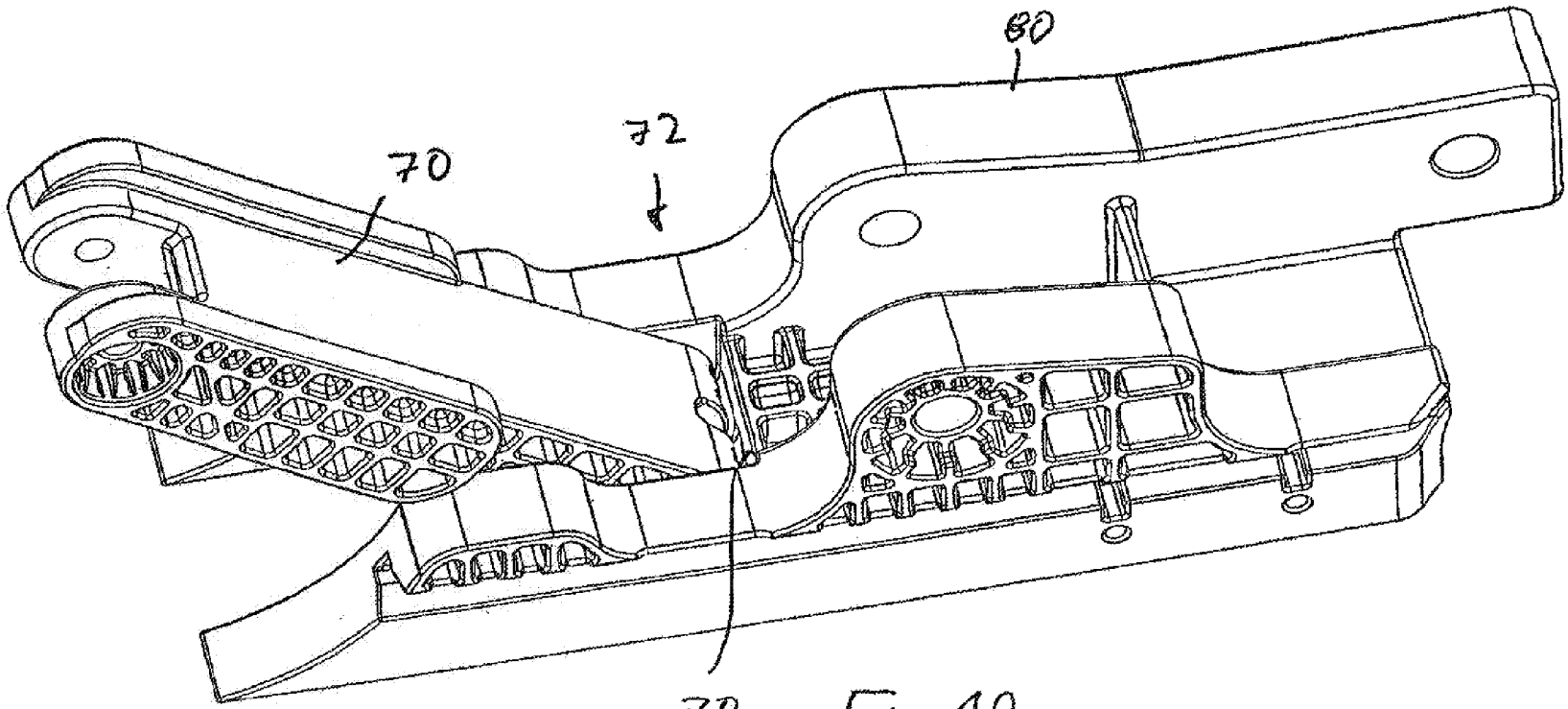
FIG. 10 shows, in the same manner as FIG. 9, the stop element and the raising lever according to FIG. 9 in a different kinematic phase.

FIG. 10 shows the first raising lever 70 during the third kinematic phase, in which it undergoes only a pivoting movement about the first pivot axis 72, and in the process rests against the stop 78.

FIG. 12 illustrates the adjustment of the upper body support part 8 by means of the raising lever assembly 68. In the illustrated embodiment, the raising lever assembly 68 acts loosely on a longitudinal beam 86 of the upper body support part 8, in that the longitudinal beam 86 rests loosely on the raising lever assembly 68. At a lateral distance from the longitudinal beam 86, the upper body support part 8 has a further longitudinal beam 88 with which a corresponding raising lever assembly (not illustrated in FIG. 12 for reasons of clarity) is associated. The raising lever assembly associated with the longitudinal beam 88 cooperates with the pull cable of the Bowden cable 44; the mode of operation is the same as described for the raising lever assembly 68, and therefore is not explained here in greater detail. Since the pull cables of the Bowden cables 44, 44' are fixed to the same spindle nut 58 (see FIG. 5), the raising lever assemblies associated with the longitudinal beams 68, 88 rise up fully synchronously, so that distortions of the upper body support part 8 during the adjustment movement are reliably avoided.

Figure 12A:
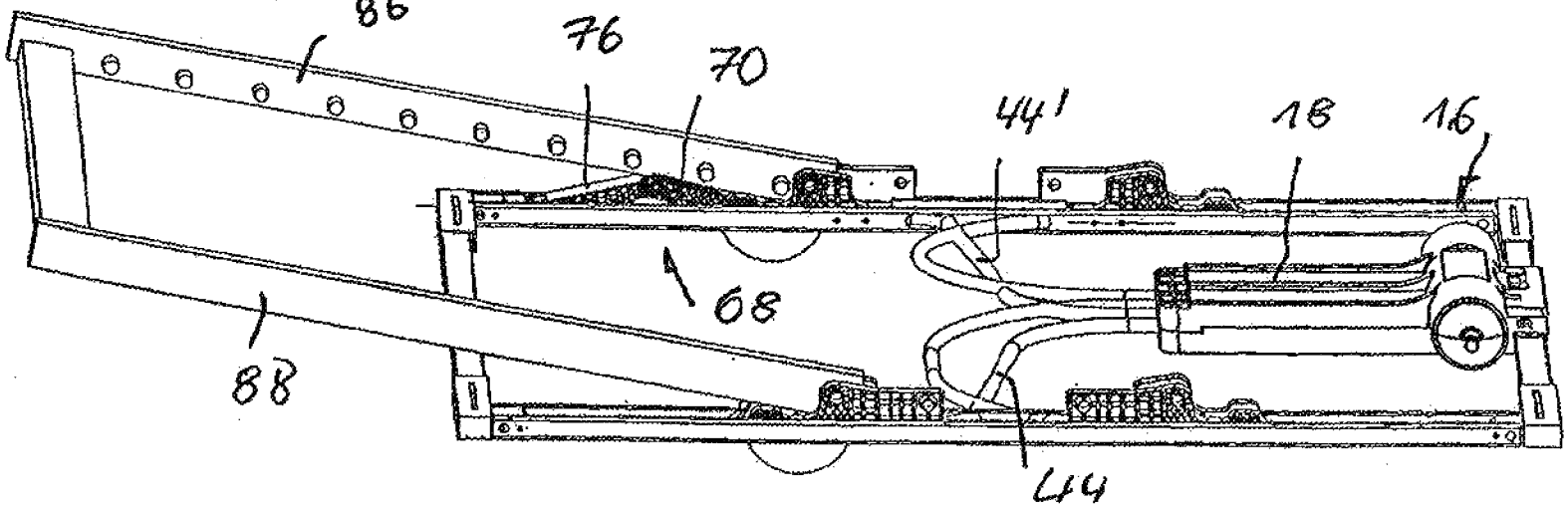
FIG. 12A shows, in the same manner as FIG. 11 but in slightly reduced scale, the mounting frame according to FIG. 3 in an adjustment position or kinematic phase in combination with a support part to be adjusted.
Figure 12B:
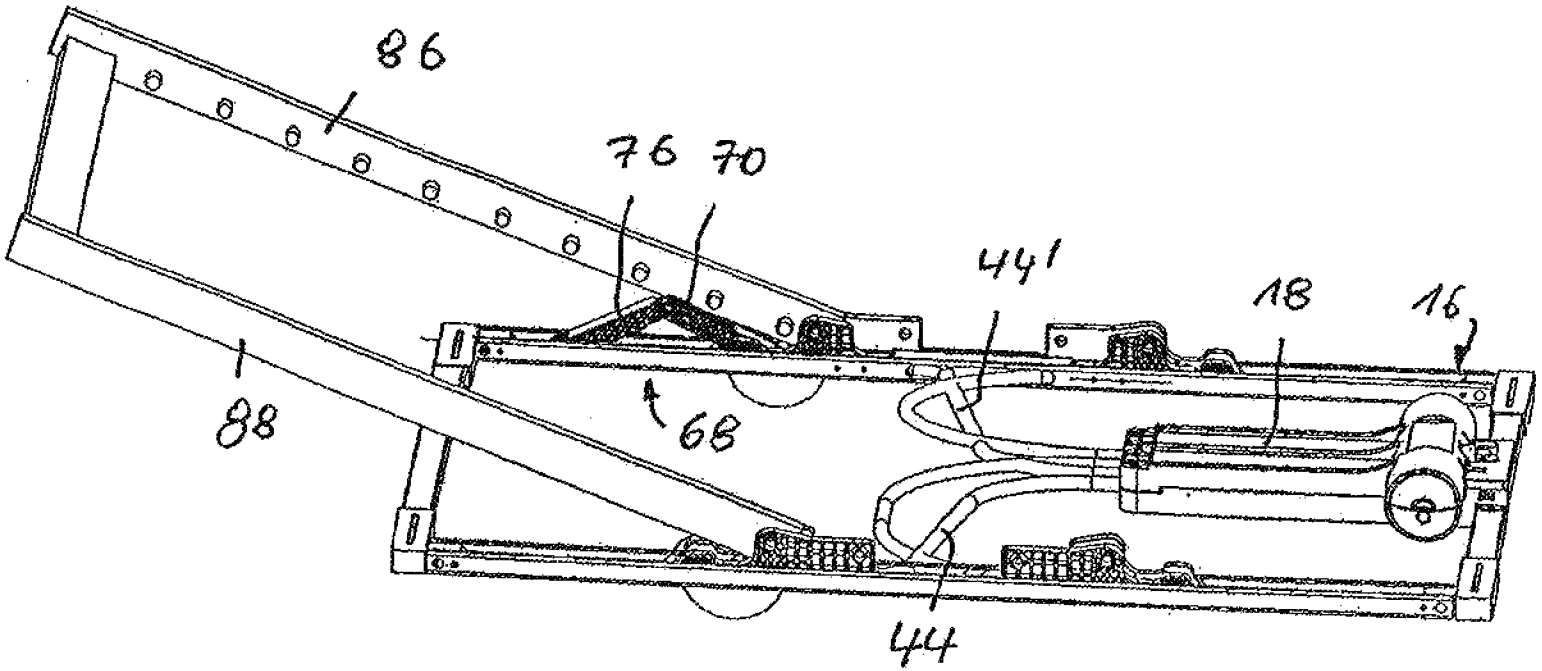
FIG. 12B shows, in the same manner as FIG. 11 but in slightly reduced scale, the mounting frame according to FIG. 3 in another adjustment position or kinematic phase in combination with a support part to be adjusted.
Figure 12C:
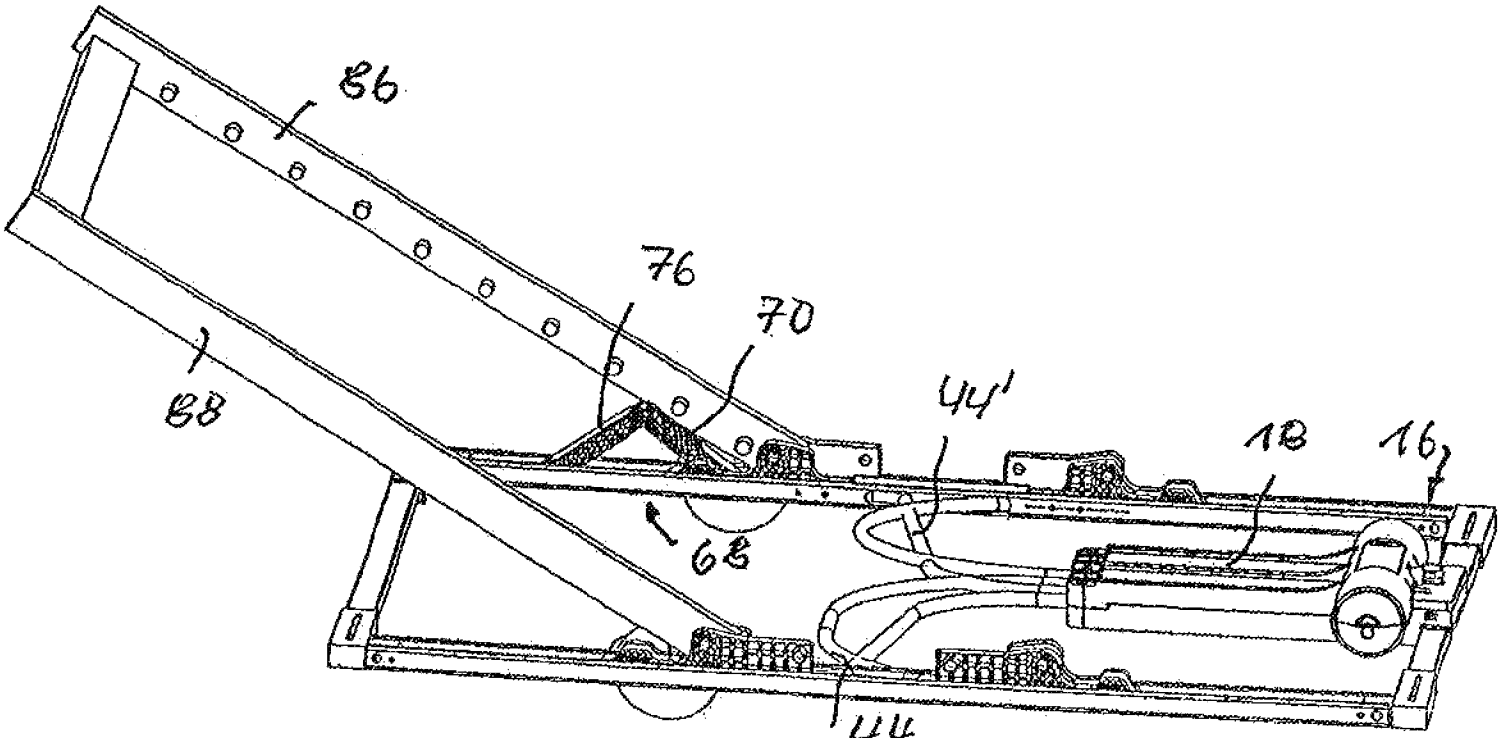
FIG. 12C shows, in the same manner as FIG. 11 but in slightly reduced scale, the mounting frame according to FIG. 3 in another adjustment position or kinematic phase in combination with a support part to be adjusted.
Figure 12D:
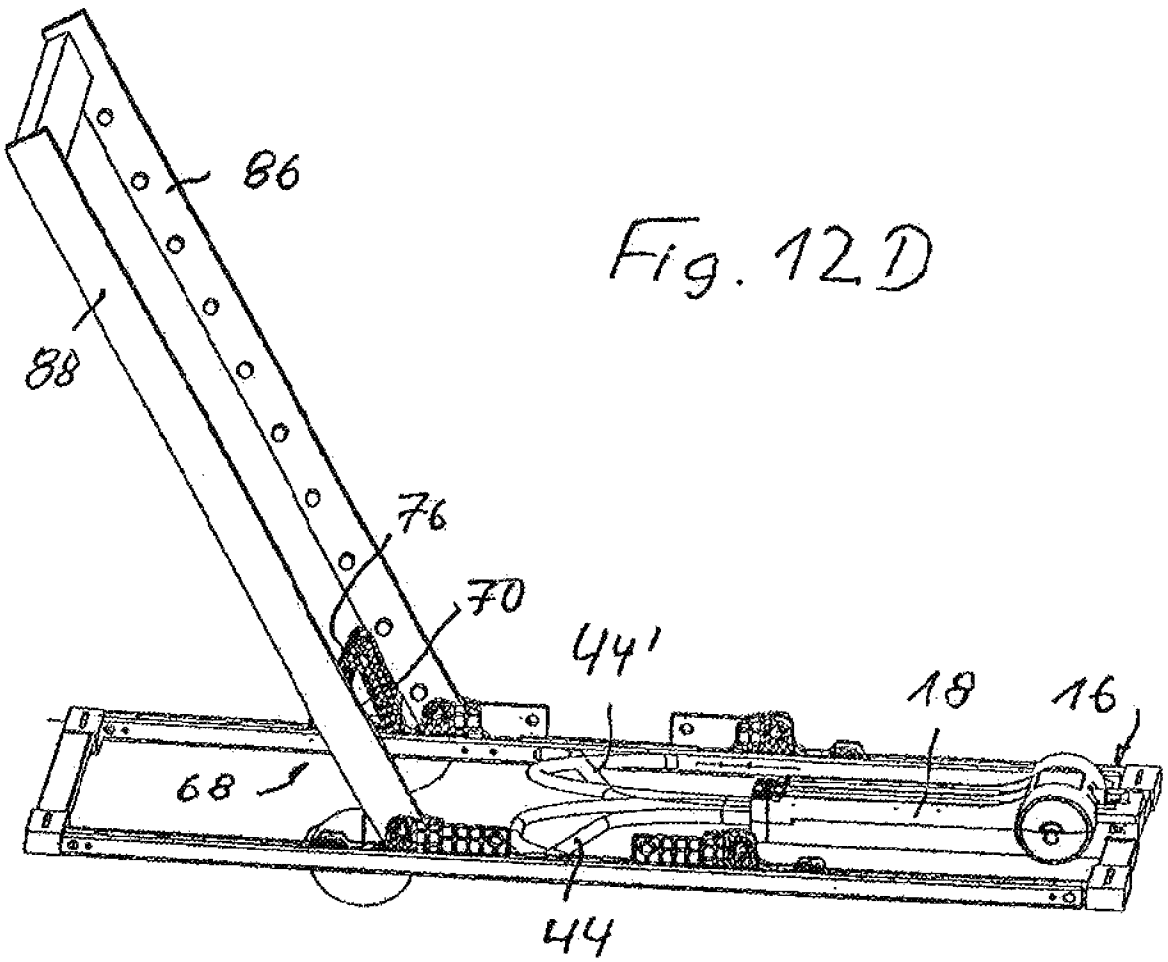
FIG. 12D shows, in the same manner as FIG. 11 but in slightly reduced scale, the mounting frame according to FIG. 3 in another adjustment position or kinematic phase in combination with a support part to be adjusted.

FIGS. 12B and 12C illustrate the further adjustment movement of the upper body support part 8. FIG. 12D shows the end position of the adjustment movement, which corresponds to a maximally adjusted position of the upper body support part 8 relative to the center support part or the mounting frame 16.

Figure 13:
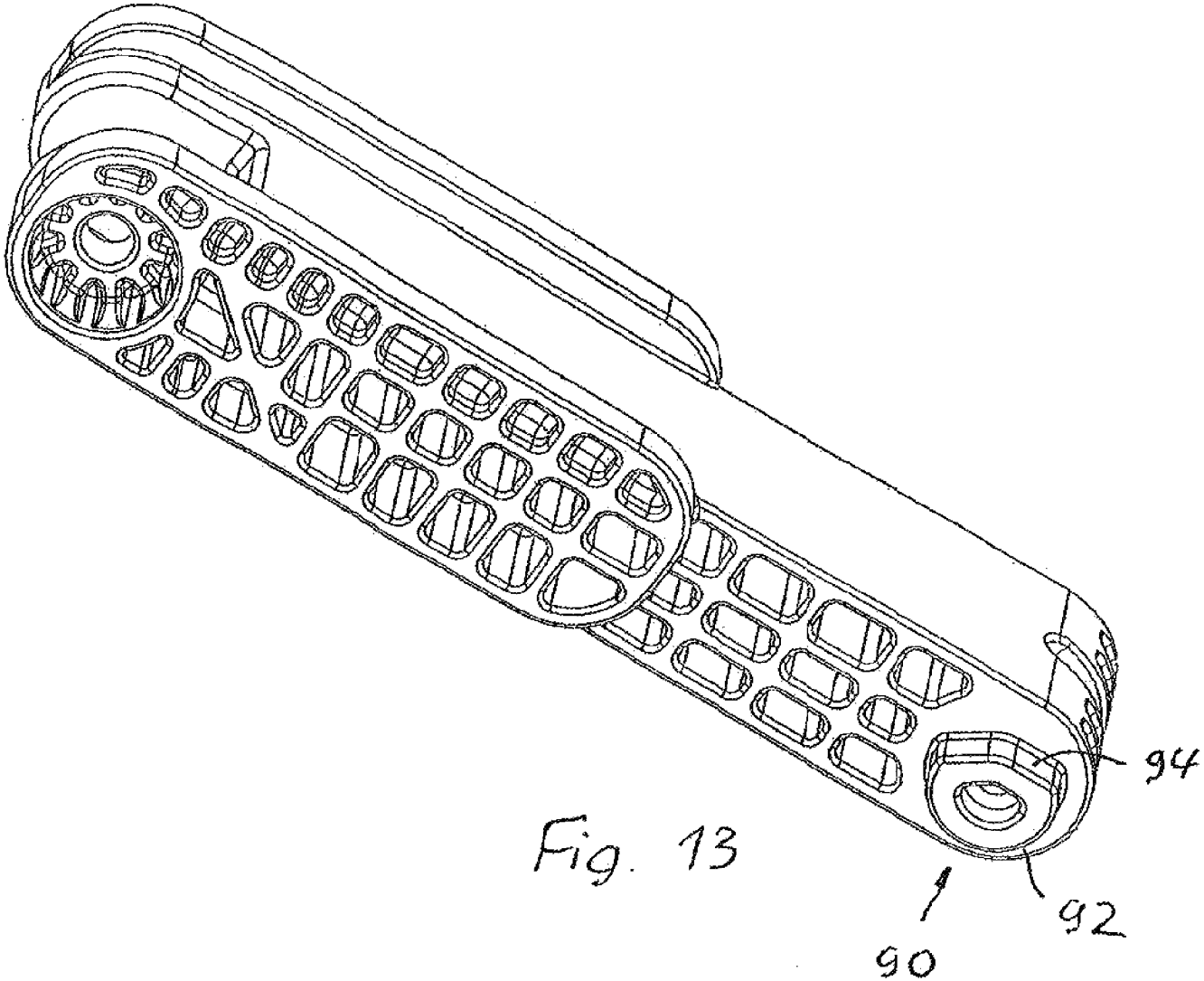
FIG. 13 shows in a perspective illustration the first raising lever by itself.
Figure 14:
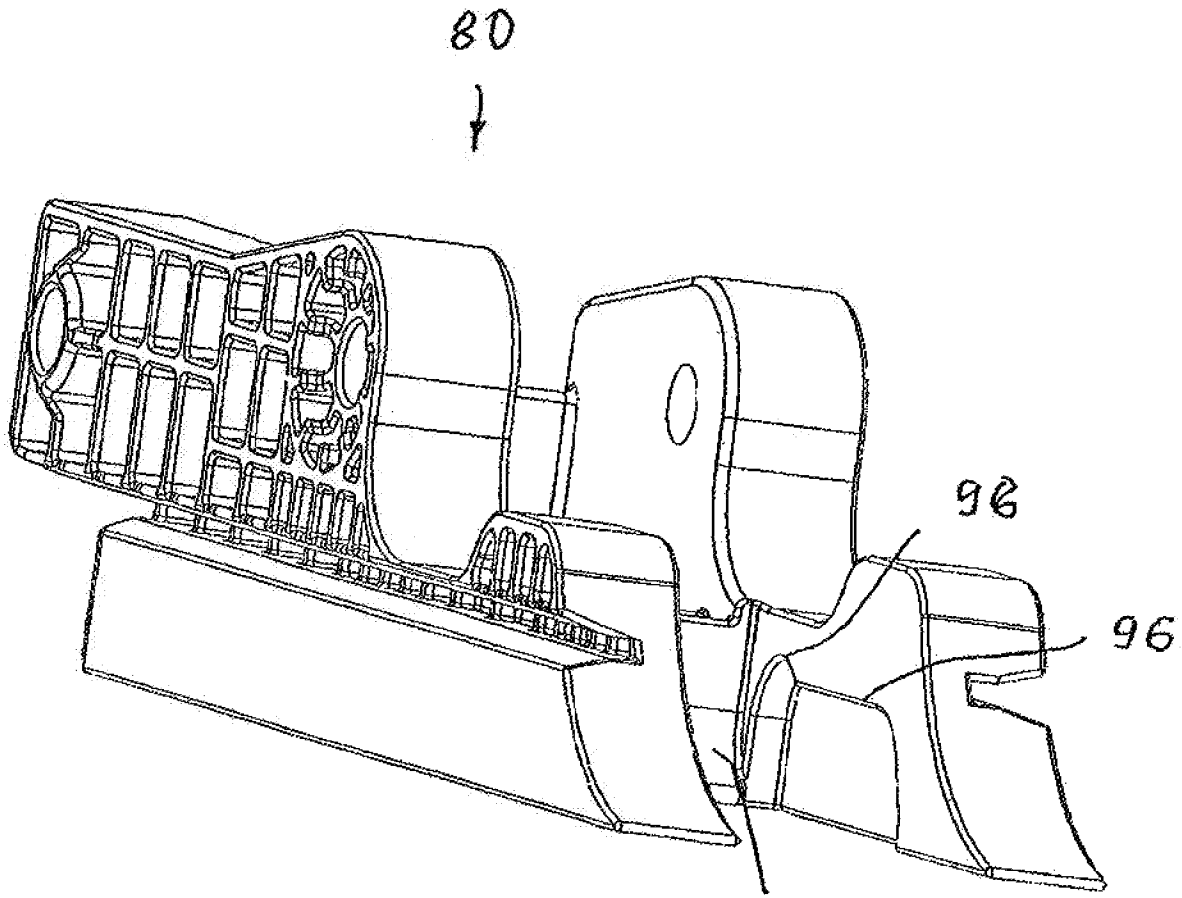
FIG. 14 shows in a perspective illustration the stop element by itself.

The locking means associated with the first raising lever 70 is explained in greater detail below with reference to FIGS. 13 and 14; FIG. 13 shows the first raising lever 70 and FIG. 14 shows the stop element 18 by itself. A locking means is associated with the first raising lever 70, and becomes operative in a predetermined raised position of the first raising lever and blocks the first raising lever 70 from undergoing a translational movement, and at the same time allows a raising movement of the first raising lever. In the illustrated embodiment, the locking means becomes operative when the first raising lever 70, resting against the stop 78 and pivoting, reaches a predetermined raised position. In the illustrated embodiment, the locking means has a bearing journal 90 (see FIG. 13) which is formed on the end of the first raising lever 70 facing the first pivot axis 72. The bearing journal 90 is designed and configured in such a way that in the locked position it is rotatably and pivotably supported in a bearing receptacle formed on the stop element 80, and in an unlocked position is released from the bearing receptacle.

As is apparent from FIG. 13, the bearing journal 90 has a bearing section 92 with a circular cross section, and a flattened area 94. As a result, in the illustrated embodiment the bearing section 92 has an approximately semicircular cross section. It is not apparent from FIG. 13, and therefore not discussed here, that the first raising lever 70 has a corresponding bearing journal on its side facing away from the bearing journal 90.

FIG. 14 shows a perspective view of the stop element 80. The stop element 80 has a groove 96, which at its end opens into a bearing surface section 98 which has a circular cross section in portions and whose diameter is greater than the inside width of the groove 96.

The mode of operation of the locking means is as follows:

As described above with reference to FIG. 7B, during the adjustment movement the end of the first raising lever 70 facing away from the second raising lever 76 runs up against the lift guide 84 and is thus lifted, resulting in raising of the raising levers 70, 76. In the process, the bearing journal 90 is translationally led in the guide formed by the groove 96. The dimensions of the inside width of the groove 96 are such that, taking the shape of the bearing journal 90 and the raising angle of the first raising lever 70 into account, the bearing journal 90 is translationally led in the guide formed by the groove 96 without jamming.

At the end of the second kinematic phase (see the above description with reference to FIG. 7C and FIG. 11C), the free end of the first raising lever 70 facing away from the second raising lever 76 runs up against the stop 78 formed on the stop element 80 in such a way that further translational movement of the raising lever assembly 86 is prevented.

During the subsequent third kinematic phase, the first raising lever 70 undergoes only a raising movement by pivoting about the first pivot axis 72. Due to the shape of the bearing journal 90 and of the bearing receptacle 98, upon further raising of the first raising lever 70 the bearing journal 92 locks onto the bearing receptacle 98 in such a way that the bearing journal is secured against translational movement, and at the same time, a further raising movement of the first raising lever 70 is allowed.

The locking means ensures that the raising lever assembly 68 uniformly lowers in the direction of the unadjusted position during a return from a maximally adjusted position. The return is completed in such a way that the first raising lever 70 pivots back in the direction of the unadjusted position. Up to a certain raised position of the first raising lever 70, the locking means allows only a rotational or pivoting motion. In a predetermined raised position the locking is discontinued, so that the bearing journal 90 subsequently moves translationally in the groove 96, in the direction facing away from the stop 78.

Without the locking means, there would be a risk that during a return, the first raising lever would immediately move translationally, resulting in sudden dropping, which is undesirable.

The mode of operation of one embodiment of a support apparatus according to the invention is explained in greater detail below with reference to FIGS. 15 to 21.

Figure 15:
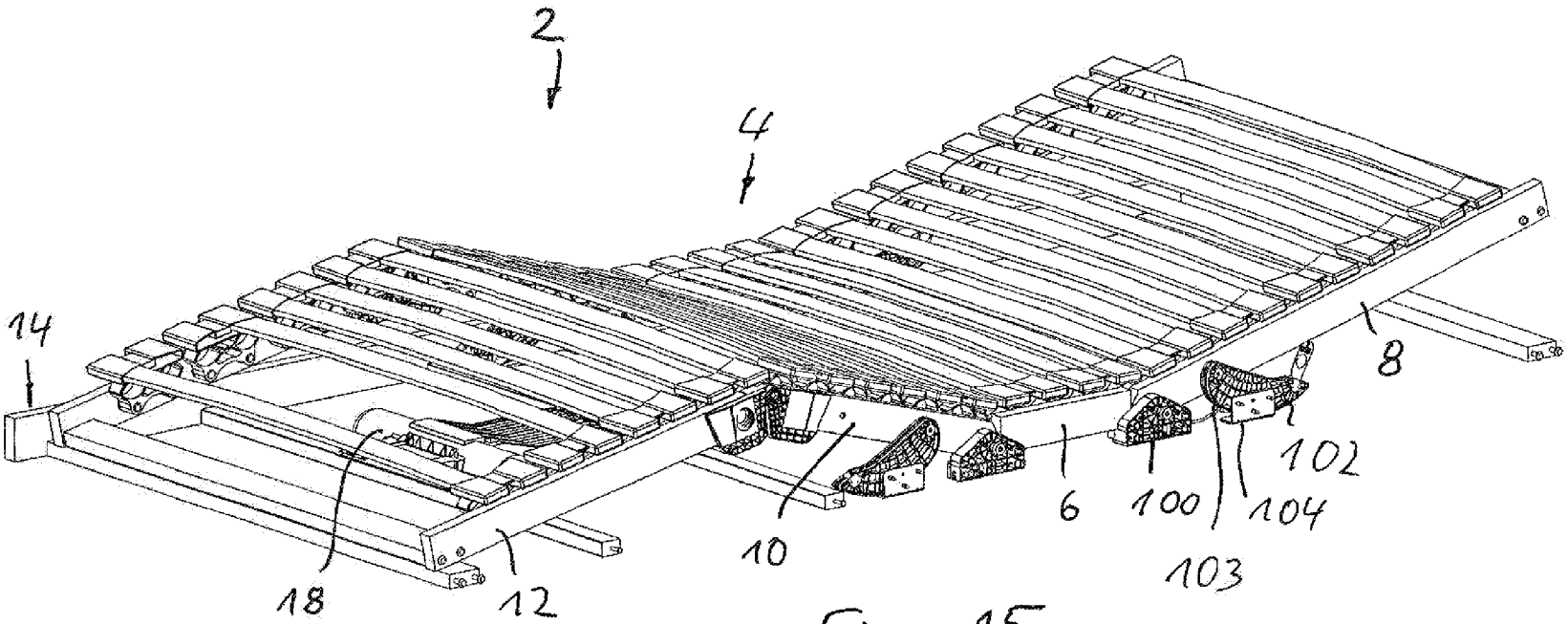
FIG. 15 shows in a perspective illustration one embodiment of a support apparatus according to the invention in a partially adjusted position.
Figure 16:
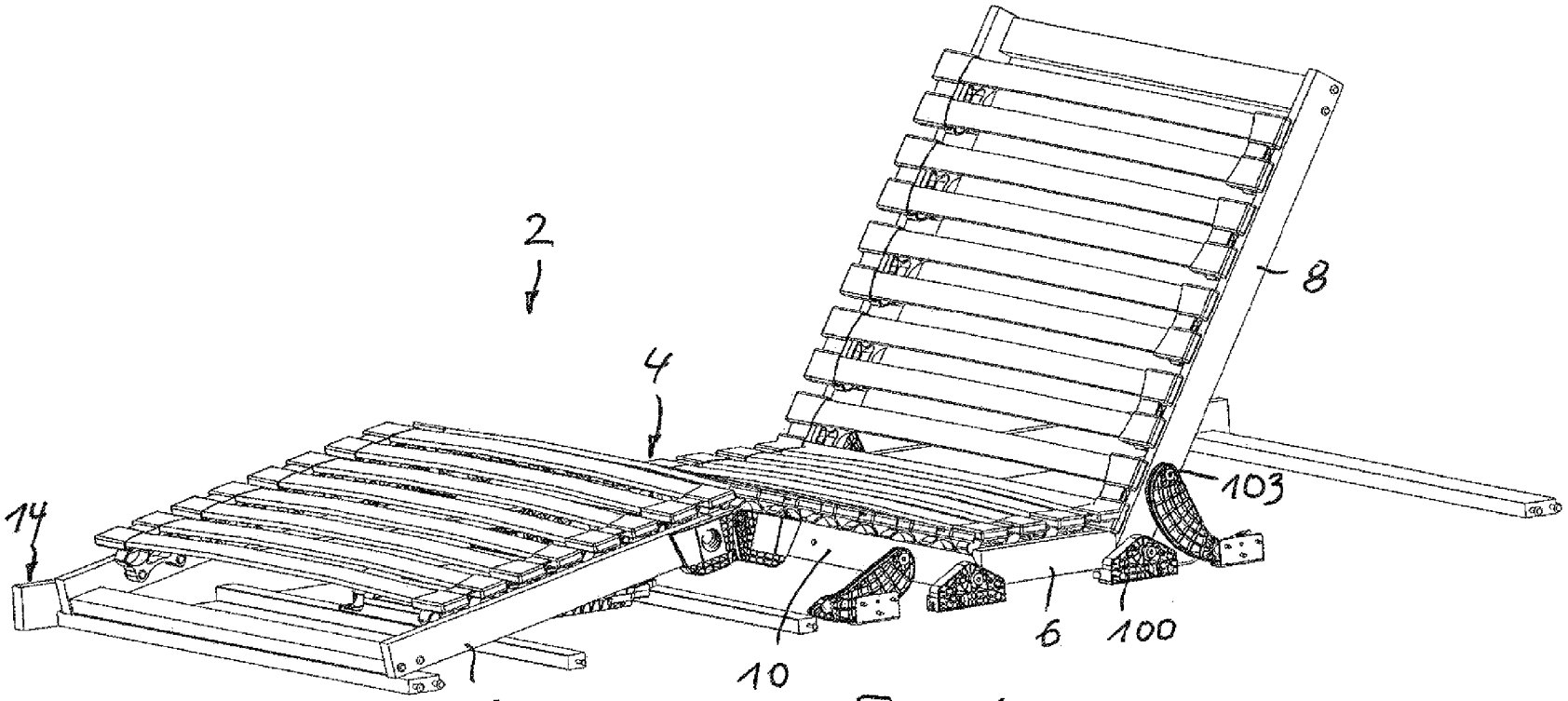
FIG. 16 shows, in the same manner as FIG. 15, the support apparatus according to FIG. 16 in an end position of the adjustment movement.

A longitudinal beam of the outer frame 4 facing the viewer is omitted in FIGS. 15 and 16 for reasons of clarity.

Only the adjustment of the upper body support part 8 relative to the center support part 6 is described below. The adjustment of the leg support part 10 together with the calf support part 12 takes place in a corresponding manner, and therefore is not explained in greater detail.

A pivot joint 100 via which the upper body support part 8 is pivotably connected to the outer frame 14 is connected to the longitudinal beam of the outer frame 14, not illustrated.

The embodiment illustrated in FIG. 15 shows an adjustment element for adjusting the upper body support part 8 relative to the center support part 6, and a pivot lever 102 which is pivotable under the traction effect of a pull cable 110 (see FIG. 17) of a Bowden cable and which is designed and in operative connection with the pull cable 110 in such a way that during an adjustment movement, the length of the lever arm which is operative for adjusting the upper body support part 8 changes during an adjustment movement between an unadjusted starting position and a maximally adjusted end position of the adjustment movement.

In the illustrated embodiment, the upper body support part 8 in the unadjusted starting position is situated essentially horizontally, and with the center support part 6, the leg support part 10, and the calf support part 12 spans a horizontal support plane for a mattress, not illustrated. A maximally adjusted end position is illustrated in FIG. 16. Accordingly, FIG. 15 illustrates an adjustment position which is between the starting position and the end position.

In the illustrated embodiment, the pivot lever 102 is designed as a curved body which is pivotably connected to the support part to be adjusted, i.e., the upper body support part 8, and which is supported on a support during the adjustment movement. In this embodiment, the support is formed by an angled lug 104 whose vertical leg is connected, for example screwed, to the longitudinal beam (omitted in FIG. 15) of the outer frame 14 of the slatted frame 2, and whose horizontal leg forms the support for the pivot lever 102.

Figure 17:
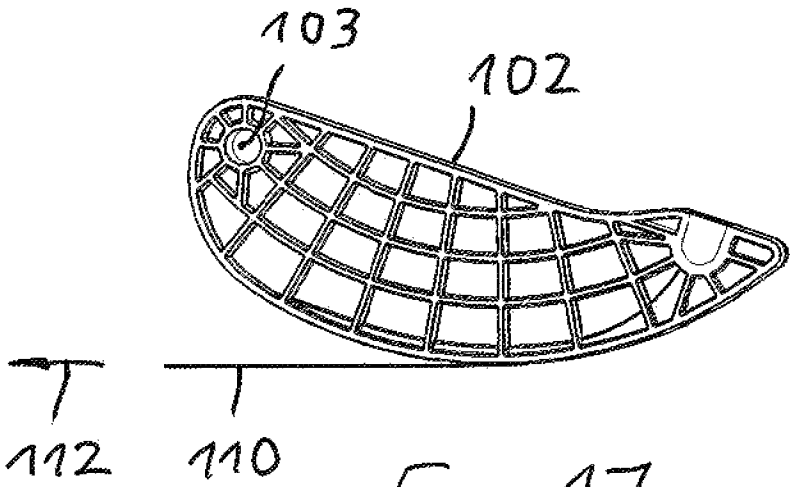
FIG. 17 shows an enlarged scale a detail of the support apparatus according to FIG. 15 in the area of an adjustment element in the form of a pivot lever.
Figure 18:
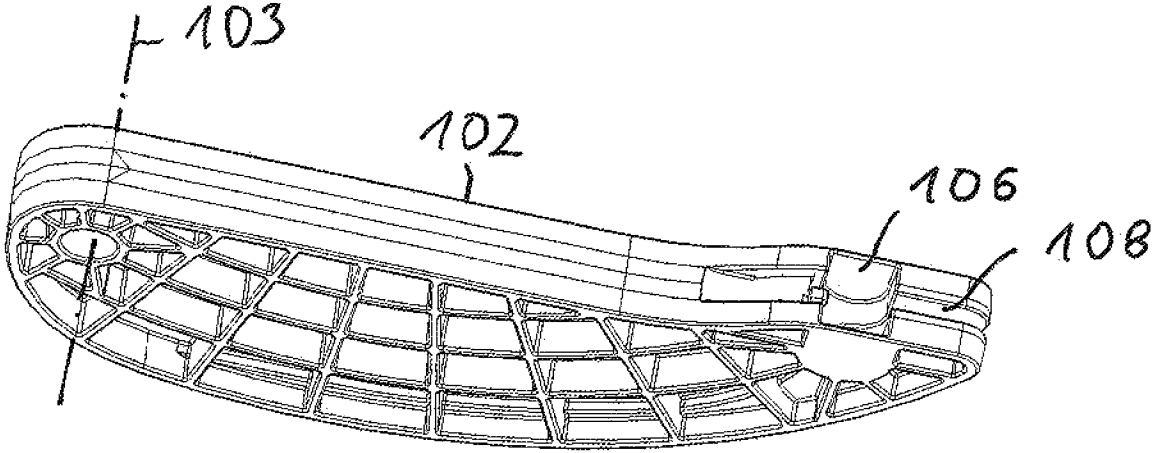
FIG. 18 shows a perspective view of the pivot lever according to FIG. 17, in a view of FIG. 17 from above.
Figure 19:
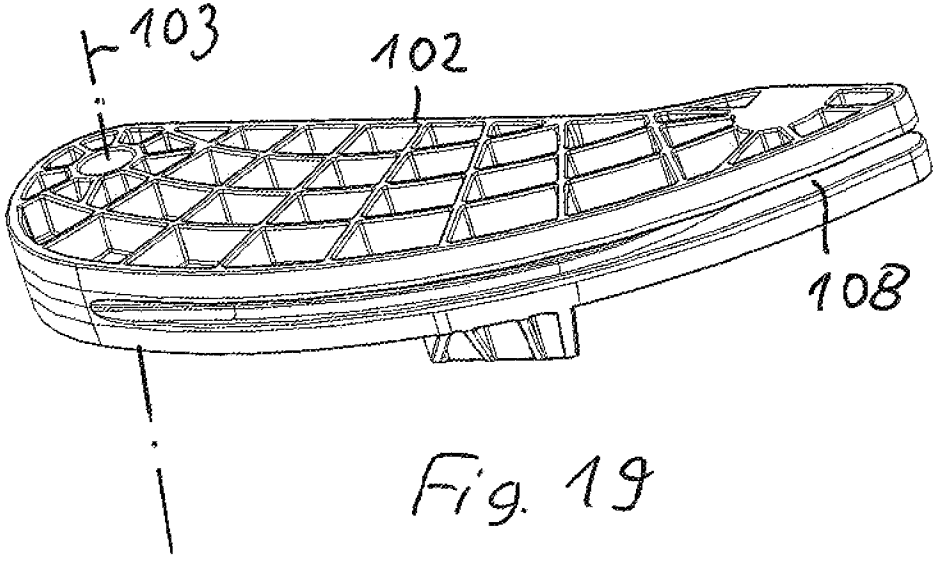
FIG. 19 shows a perspective view of the pivot lever according to FIG. 17, in a view of FIG. 17 from below.

FIG. 17 shows the pivot lever 102 by itself in a side view, while FIG. 18 shows a perspective view from above and FIG. 19 shows a perspective view from below.

For fixing the end of the pull cable 110 of the Bowden cable, the pivot lever 102 on its end facing away from the pivot axis 103 has a recess 106 into which a cylindrical fastening nipple is insertable in a positive-fit manner at the free end of the pull cable 110 of the Bowden cable. Extending from the recess 106 in the peripheral direction of the pivot lever 102 is a groove 108 which leads around the end of the pivot lever 102 facing away from the pivot axis 103 (see FIG. 18), and from there leads in the peripheral direction of the pivot lever 102 (see FIG. 19) in the direction of the end of the pivot lever 102 facing the pivot axis 103. The resulting course of the pull cable of the Bowden cable is indicated by reference numeral 110 in FIG. 17. The direction of a force which seeks to pivot the pivot lever 102 about the pivot axis 103 in the counterclockwise direction in the drawing is symbolized by an arrow 112 in FIG. 17.

It is apparent in particular from FIG. 17 that the pivot lever 102 is designed as a curved body on its circumferential surface with which it is supported on the support during the adjustment movement, so that the length of the lever arm which is operative for adjusting the upper body support part 8 during an adjustment from the unadjusted starting position into the maximally adjusted end position of the adjustment movement changes.

To adjust the upper body support part from its unadjusted starting position, i.e., the adjustment position illustrated in FIG. 15, in the direction of the end position illustrated in FIG. 16, the drive unit 18 is controlled in such a way that the pull cable 110 is pulled in the direction of the arrow 112, so that the pivot lever 102 pivots in the counterclockwise direction in the drawing. The pivot lever 102 is thus supported on the support 104, and the circumferential surface of the pivot lever, which has a curved cross section, rolls on the support during the adjustment movement. During the pivoting and raising of the pivot lever 102, the upper body support part 8 is pivoted from the adjustment position illustrated in FIG. 15 to the end position of the adjustment movement illustrated in FIG. 16.

Figure 20:
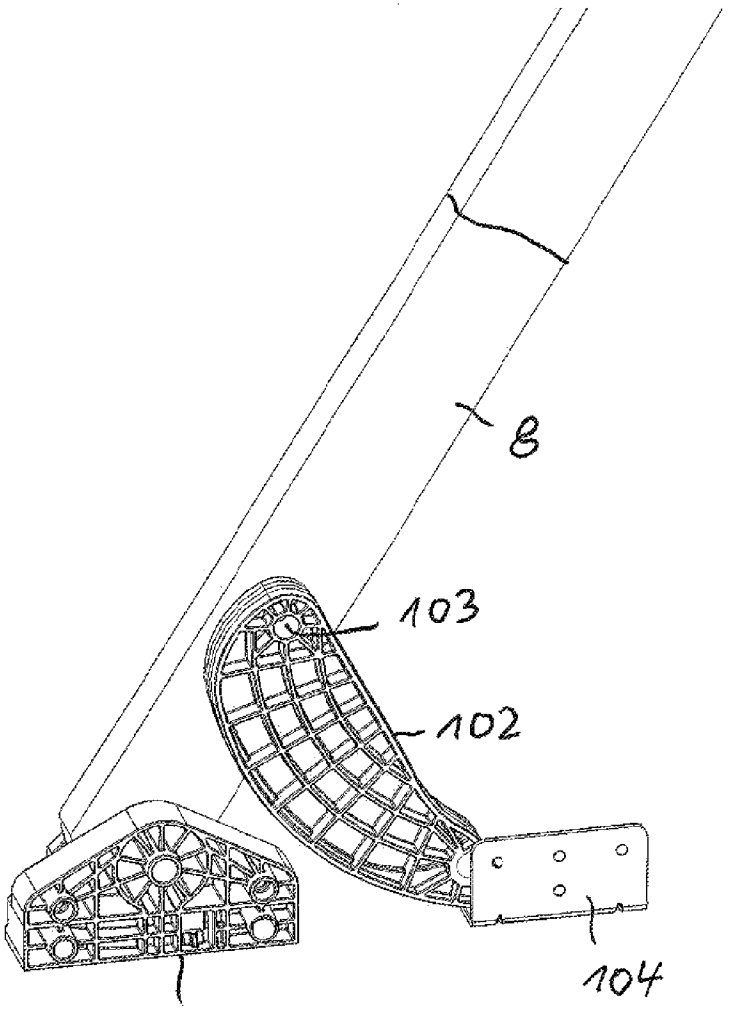
FIG. 20 shows a perspective view of the pivot lever according to FIG. 17 in cooperation with an upper body support part and a support.

FIG. 20 shows a detail in the area of the pivot lever 102 and of the bearing 104 in the end position of the adjustment movement.

Figure 21:
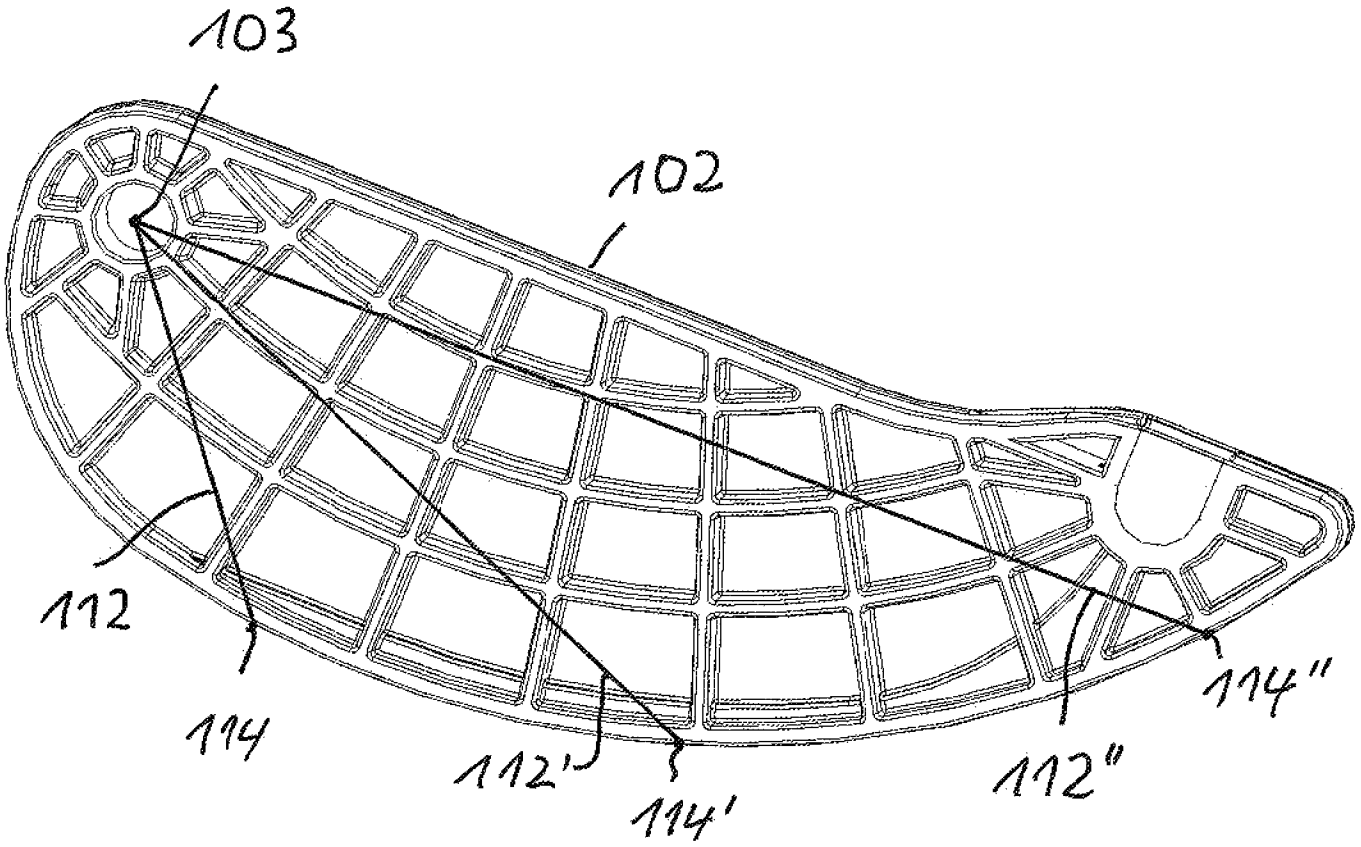
FIG. 21 shows, in an illustration similar to FIG. 17 but in an enlarged scale, a view of the pivot lever for illustrating the changing length of the operative lever arm during pivoting of the pivot lever during the adjustment movement.

FIG. 21 denotes by reference numeral 112 the active lever arm that results when the pivot lever 102 is supported on the support 104 at a circumferential point 114 on its outer circumference in various phases of the adjustment movement. Similarly, reference numerals 112' and 112" denote the active lever arm that results when the pivot lever 102 is supported on the support 104 on a circumferential point 114' and 114" of its circumference. It is apparent that the curved body which forms the pivot lever 102 is shaped in such a way that the length of the active lever arm increases toward the end position of the adjustment movement. Accordingly, the adjustment force exerted on the upper body support part 8 increases toward the end position of the adjustment movement. It is apparent that the force curve may be set according to the particular requirements by appropriately shaping the cross section of the curved body. As already explained with reference to FIGS. 1 to 14, in the illustrated embodiments an adjustment element is associated with each side beam of a support part to be adjusted, whereby the adjustment elements associated with a support part are each connected to a pull cable of a Bowden cable, and these pull cables are synchronously activated, so that the drive force of the drive unit is introduced into the support parts symmetrically with respect to the longitudinal center plane of the slatted frame 2.

As already stated, the adjustment of the leg support part 10 together with the calf support part 12 takes place according to the same functional principle as the adjustment of the upper body support part 8.

A further embodiment of a support apparatus according to the invention is described below with reference to FIGS. 22 to 28.

The further embodiment is designed for supporting a so-called box spring mattress, the support parts 6, 8, 10, 12 having a plate-shaped design.

The mode of operation of the further embodiment is explained in greater detail below with reference to the adjustment of the upper body support part 8. The adjustment of the leg support part 10 together with the calf support part 12 takes place according to the same functional principle, and therefore is not explained here in greater detail.

Figure 22:
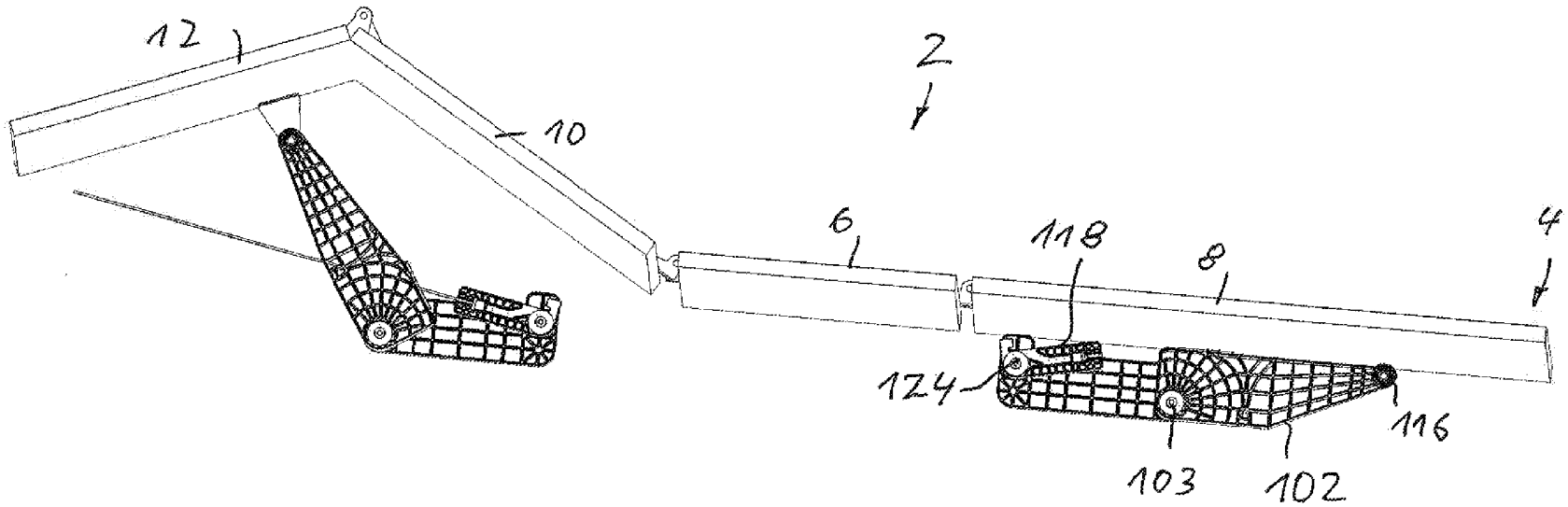
FIG. 22 shows, in a slight perspective view, a second preferred embodiment of a support apparatus according to the invention in an unadjusted starting position of an upper body support part.
Figure 23:
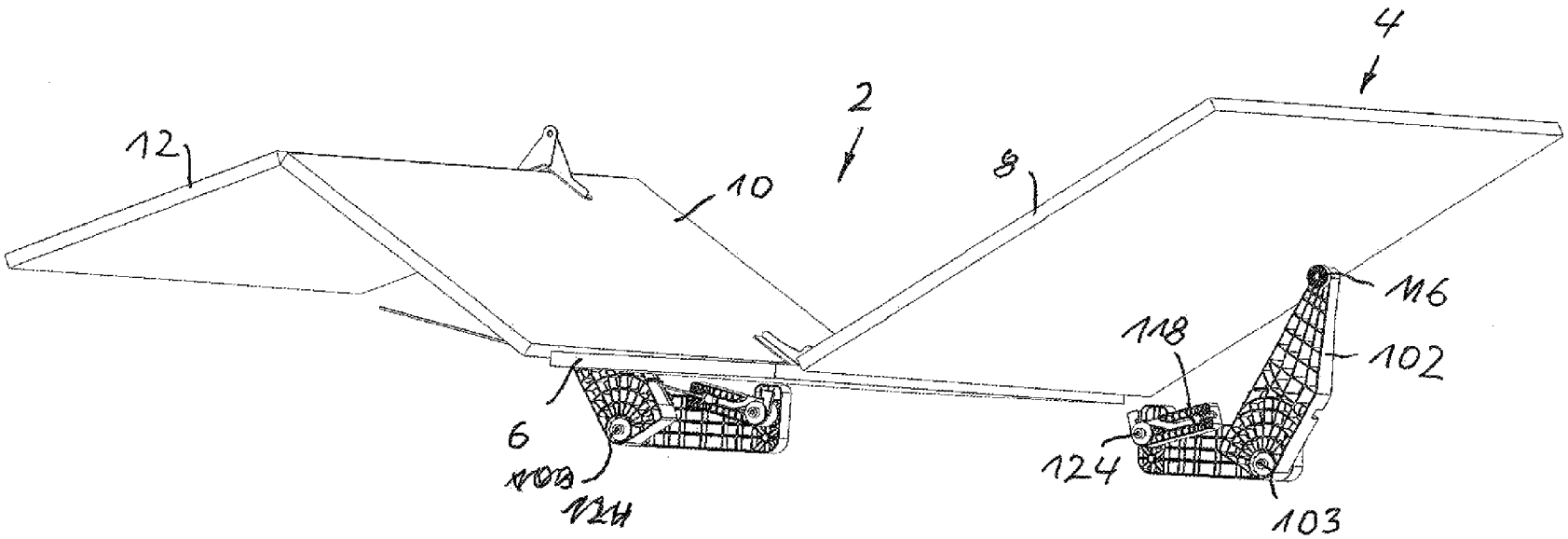
FIG. 23 shows, in an illustration similar to FIG. 22, the embodiment according to FIG. 22, with the upper body support part shown in a partially adjusted adjustment position.
Figure 24:
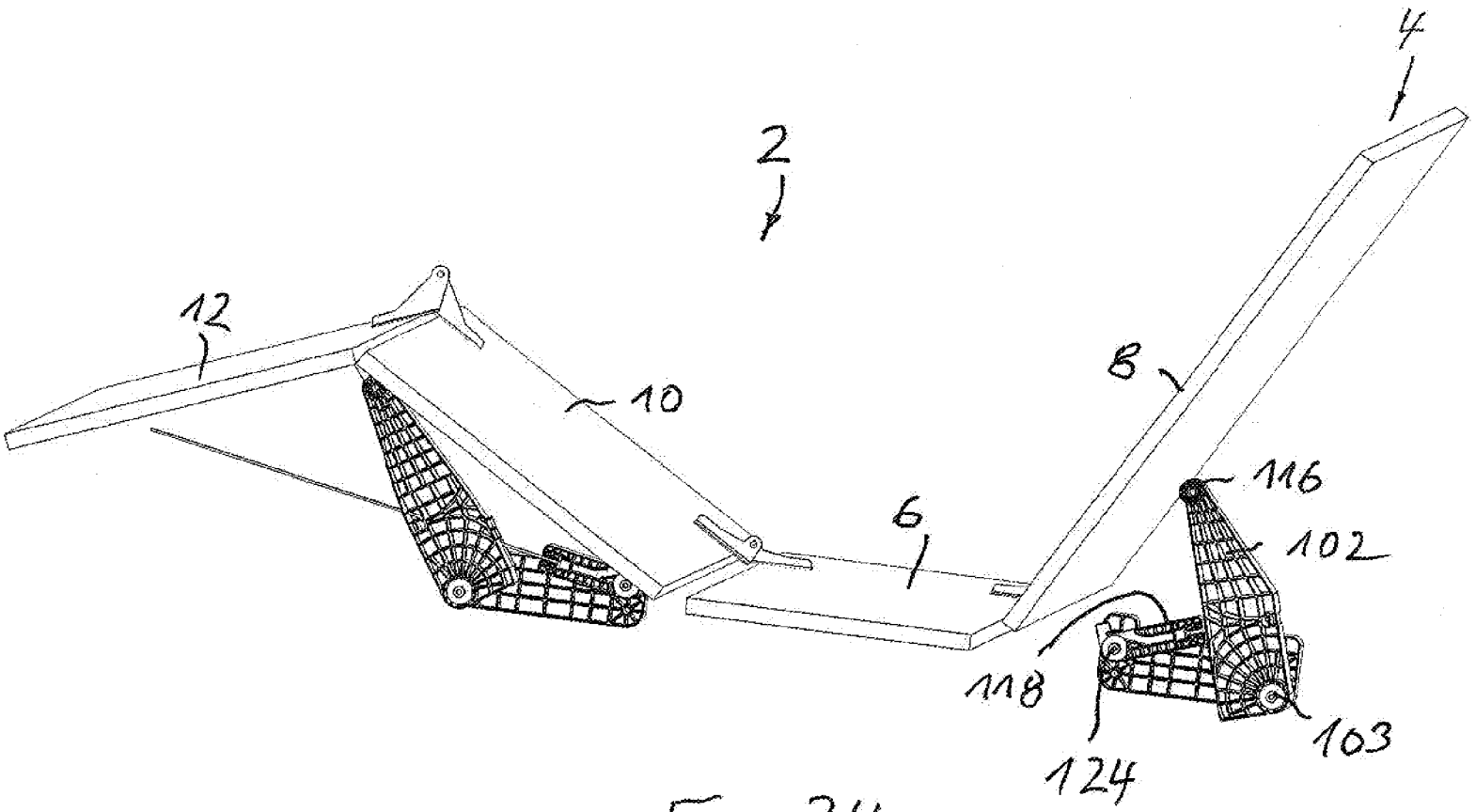
FIG. 24 shows, in an illustration similar to FIG. 22, the embodiment according to FIG. 22, with the upper body support part illustrated in its maximally adjusted end position of the adjustment movement.

FIG. 22 shows the upper body support part 8 in an unadjusted starting position, while FIG. 24 shows the maximally adjusted end position and FIG. 23 shows an adjustment position in between. The outer frame 14 of the support apparatus is omitted in each of FIGS. 22 to 24 for reasons of clarity.

In this regard, the further embodiment represents a kinematic reversal of the embodiment described with reference to FIGS. 15 to 21, since the pivot lever 102 is connected to the outer frame 14, pivotably about the pivot axis 103, via a pivot bearing fastened to a longitudinal beam of the outer frame 14. The end of the pivot axis 102 facing away from the pivot axis 103 forms a support for the upper body support part 8, which in the illustrated embodiment is acted on loosely by the pivot lever 102 and is supported on a roller 116 fastened to the free end of the pivot lever 102.

Figure 25:
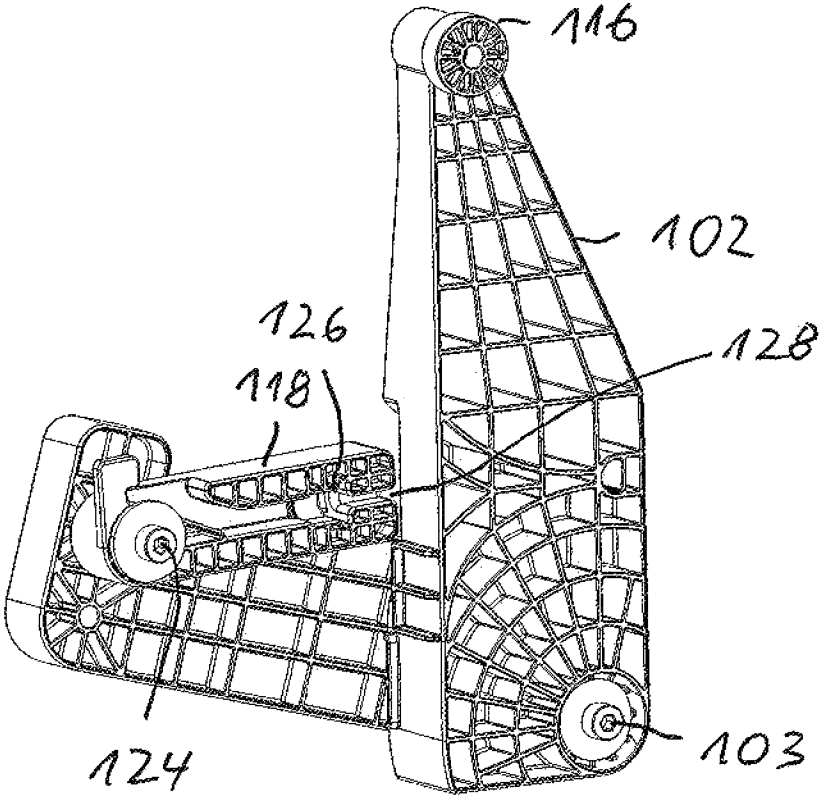
FIG. 25 shows, in enlarged scale compared to FIG. 24, a detail from FIG. 24 in the area of a pivot lever.

FIG. 25 shows the pivot lever 102 in a position in which it is in the end position of the adjustment movement (see FIG. 24), in combination with a holding part 118 which holds an end, facing the pivot lever 102, of sheathing of a Bowden cable whose pull cable is used for pivoting the pivot lever 102 and is fixed thereto. The pull cable of the Bowden cable is denoted by reference numeral 110 in FIG. 27. However, in other respects the Bowden cable, including the pull cable and sheathing, is omitted in the drawing for reasons of clarity.

Figure 27:
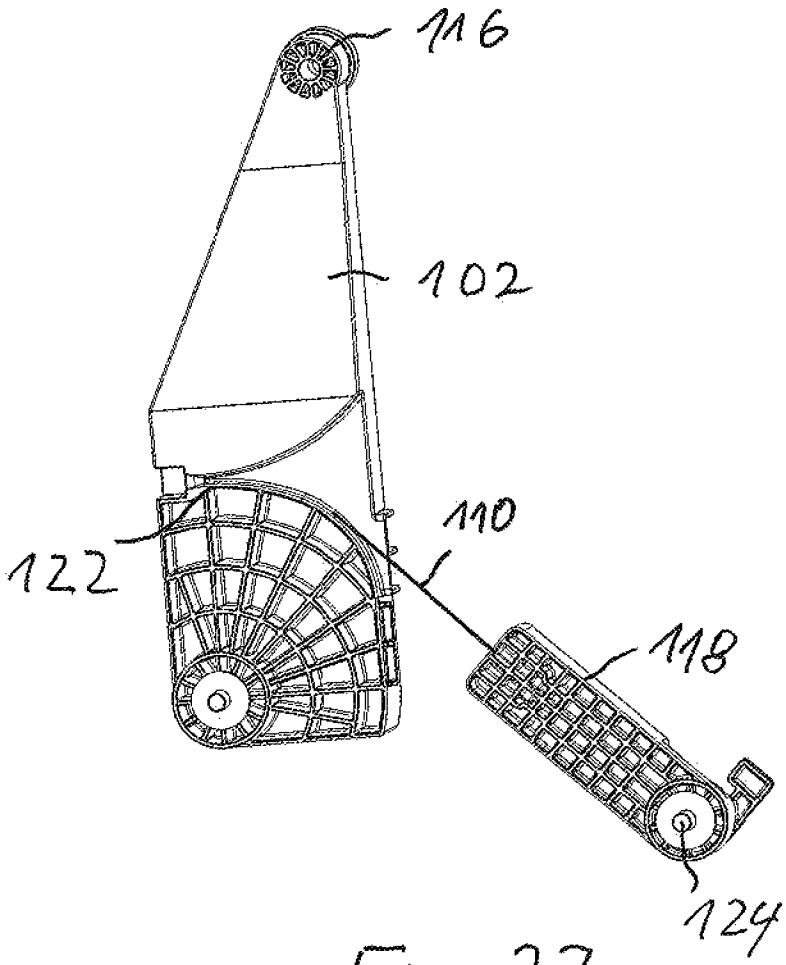
FIG. 27 shows a perspective view of the pivot lever in combination with the holding part.
Figure 28:
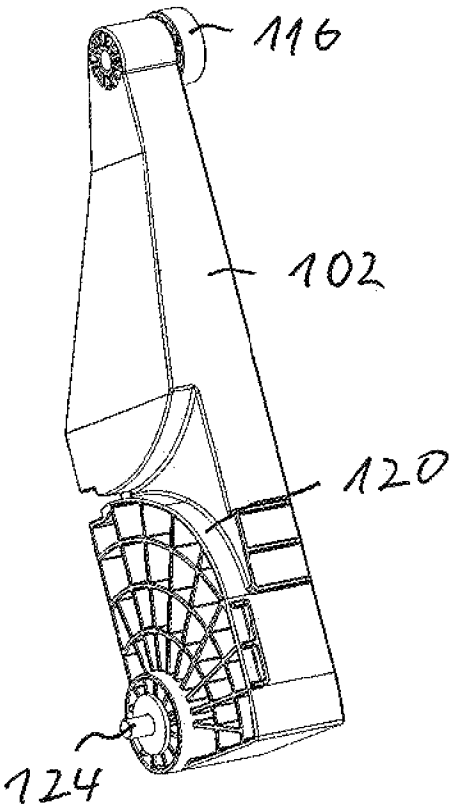
FIG. 28 shows a perspective view of the pivot lever according to FIG. 27 from a different perspective.

FIG. 28 shows the pivot lever 102 in a perspective view. In the illustrated embodiment, the pivot lever 102 is designed in one piece with a curved body 120. The free end of the pull cable 110 is fixed tightly to the end 122 facing away from the holding part 118, and from there is guided over the curved body to the holding part 118 (see FIG. 27).

It is apparent in particular from FIGS. 27 and 28 that the curved body 120 is shaped in such a way that the length of the lever arm which is operative for adjusting the upper body support part 8 lengthens during an adjustment between the unadjusted starting position (see FIG. 22) and the maximally adjusted end position (see FIG. 24).

As illustrated in FIG. 25, the holding part 118 is supported so as to be pivotable about a pivot axis 124 parallel to the pivot axis 103. The holding part has a jaw-like receptacle 126 to which the sheathing of the Bowden cable is fixed, whereby the pull cable of the Bowden cable is guided by a recess 128 which is formed on the end of the holding part 118 facing away from the pivot axis 124, and is guided by the receptacle 126 (see FIG. 25), and from there to the curved body 120 (see FIG. 27).

Figure 26:
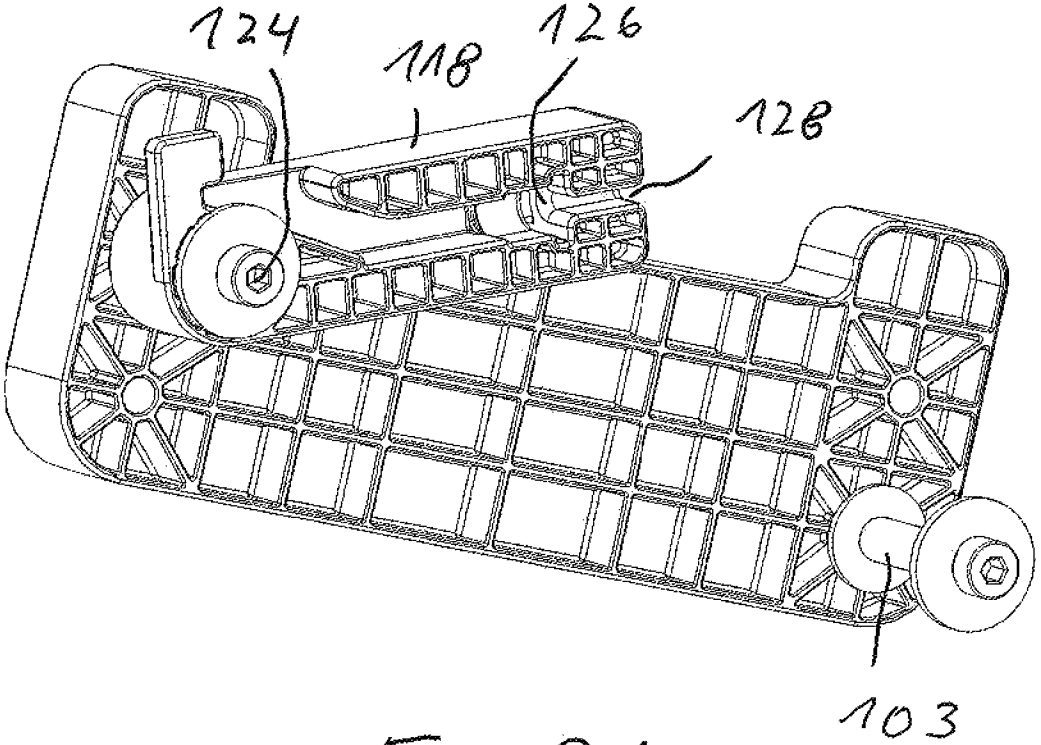
FIG. 26 shows, in enlarged scale compared to FIG. 25, a detail from FIG. 25 in the area of a holding part for a Bowden cable.

FIG. 26 shows the holding part 118 by itself.

The mode of operation of the embodiment illustrated in FIGS. 22 to 28 is as follows:

For adjusting the upper body support part 8, the drive unit exerts a tensile force on the pull cable 110, so that the pivot lever is pivoted from the starting position illustrated in FIG. 22, via the adjustment position illustrated in FIG. 23, up to the maximum adjustment position of the adjustment movement illustrated in FIG. 24, and thus pivots the upper body support part 8 in the desired manner.

Since the pull cable 110 is guided over the curved body 120, the lever arm which is operative during the adjustment of the upper body support part 8 during the adjustment movement lengthens toward the end position of the adjustment movement.

Due to the pivotable bearing of the holding part 118, the holding part follows changes in direction of the pull cable 110 in the peripheral direction of the pivot axis 124, thus avoiding a radial load on the sheathing of the Bowden cable.

Identical or corresponding components are provided with the same reference numerals in the various figures of the drawing and the various embodiments. When components are omitted in the figures of the drawing for reasons of illustration or depiction, the components in question are intended to complement the respective other figures accordingly. It is apparent to those skilled in the art that the features of the individual embodiments are also exchangeable among the embodiments, and the features disclosed with regard to one embodiment may also be present in identical or corresponding form in the other embodiments. It is also apparent to those skilled in the art that the features disclosed for the individual embodiments in each case further embody the invention taken alone, i.e., independently of the further features of the particular embodiment.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. Electromotively adjustable support apparatus for supporting padding of seating or reclining furniture, the support apparatus comprising:

a) a first and second support part which are adjustable relative to one another;

b) an adjustment element associated with the first support part for adjusting the first support part, the adjustment element being in drive connection with an electric motor of a drive unit;

c) the adjustment element being a pivot lever which is pivotable under the traction effect of a pull cable of a Bowden cable, and which pivot lever is configured and is in operative connection with the pull cable in such a way that the length of the lever arm which is operative for adjusting the first support part changes during an adjustment between an unadjusted starting position and a maximally adjusted end position of the first supporting part;

d) the pivot lever acting on the support part to be adjusted such that, when the pivot lever pivots under the traction effect of the Bowden cable, the support part is adjusted by the pivot lever; and e) the drive connection being a pivot drive connection, and the pull cable of the Bowden cable being guided around a curved body, the curved body being in pivot drive connection with the pivot lever.

2. Support apparatus according to claim 1, wherein:

a) the pivot lever is configured as a curved body which is pivotably connected to the first support part to be adjusted, and which rolls on a support during the adjustment movement.

3. Support apparatus according to claim 2, wherein:

a) the first support is configured as an essentially flat surface.

4. Support apparatus according to claim 3, wherein:

a) the first support is formed on a lug which is connectable to an outer frame of the support apparatus.

5. Support apparatus according to claim 2, wherein:

a) the first support is formed on a lug which is connectable to an outer frame of the support apparatus.

6. Support apparatus according to claim 1, wherein:

a) the drive connection is a pivot drive connection, and the pull cable of the Bowden cable is guided around the curved body which is in pivot drive connection with the pivot lever.

7. Support apparatus according to claim 6, wherein:

a) the curved body is connected in a rotationally fixed manner to the pivot lever.

8. Support apparatus according to claim 6, wherein:

a) the curved body is configured as one piece with the pivot lever.

9. Support apparatus according to claim 6, wherein:

a) the Bowden cable includes a sheathing, and an end of the sheathing of the Bowden cable facing the curved body is held on a holding part which is supported so as to be pivotable about a pivot axis in such a way that the sheathing of the Bowden cable follows changes in direction of the pull cable in a peripheral direction of the pivot axis.

10. Support apparatus according to claim 9, wherein:

a) the pivot axis of the holding part is parallel to the pivot axis of the pivot lever.

11. Support apparatus according to claim 6, wherein:

a) the curved body is shaped in such a way that the active lever arm lengthens toward a maximally adjusted end position of the adjustment movement.

12. Support apparatus according to claim 11, wherein:

a) the curved body is shaped in such a way that the active lever arm lengthens in phases toward a maximally adjusted end position of the adjustment movement.

13. Support apparatus according to claim 1, wherein:

a) the curved body is connected in a rotationally fixed manner to the pivot lever.

* * * * *